US006562531B2

(12) United States Patent
Niimi

(10) Patent No.: US 6,562,531 B2
(45) Date of Patent: May 13, 2003

(54) ELECTROPHOTOGRAPHIC PHOTORECEPTOR, AND IMAGE FORMING METHOD AND APPARATUS USING THE PHOTORECEPTOR

(75) Inventor: Tatsuya Niimi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/903,718

(22) Filed: Jul. 13, 2001

(65) Prior Publication Data

US 2002/0076633 A1 Jun. 20, 2002

(30) Foreign Application Priority Data

| | | |
|---|---|---|
| Oct. 4, 2000 | (JP) | 2000-305428 |
| Feb. 27, 2001 | (JP) | 2001-051714 |
| Jul. 25, 2001 | (JP) | 2001-225132 |

(51) Int. Cl.[7] ..... G03G 5/147; G03G 5/05

(52) U.S. Cl. ..... 430/66; 430/59.6; 430/126; 399/159

(58) Field of Search ..... 430/66, 59.6, 126; 399/159

(56) References Cited

U.S. PATENT DOCUMENTS

| | | | |
|---|---|---|---|
| 5,039,584 | A | 8/1991 | Odell et al. |
| 5,547,790 | A | 8/1996 | Umeda et al. |
| 5,677,094 | A | 10/1997 | Umeda et al. |
| 5,804,343 | A | 9/1998 | Umeda et al. |
| 5,853,935 | A | 12/1998 | Suzuki et al. |
| 5,871,876 | A | 2/1999 | Ikuno et al. |
| 6,030,733 | A | 2/2000 | Kami et al. |
| 6,087,055 | A | 7/2000 | Niimi |
| 6,132,911 | A | 10/2000 | Niimi |
| 6,146,800 | A * | 11/2000 | Yoshida et al. ..... 430/66 |
| 6,218,533 | B1 | 4/2001 | Niimi |
| 6,326,112 | B1 | 12/2001 | Tamura et al. |

FOREIGN PATENT DOCUMENTS

| | | |
|---|---|---|
| EP | 0 046 958 | 3/1982 |
| EP | 0 670 523 | 9/1995 |
| EP | 0 841 595 | 5/1998 |
| JP | 53-133444 | 11/1978 |
| JP | 55-157748 | 12/1980 |
| JP | 57-030846 | 2/1982 |
| JP | 58-121044 | 7/1983 |
| JP | 59-223442 | 12/1984 |
| JP | 59-223443 | 12/1984 |
| JP | 59-223445 | 12/1984 |
| JP | 63-148263 | 6/1988 |
| JP | 01-172970 | 7/1989 |
| JP | 02-004275 | 1/1990 |
| JP | 04-281461 | 10/1992 |
| JP | 07-084377 | 3/1995 |
| JP | 09-311479 | 12/1997 |
| JP | 09-311487 | 12/1997 |
| JP | 10-133405 | 5/1998 |
| JP | 2000-066434 | 3/2000 |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoreceptor including at least an electroconductive substrate, a photosensitive layer formed on the substrate and a protective layer formed on the photosensitive layer and including a binder resin, wherein when a solution in which the binder resin is dissolved in an organic solvent incompatible with water is mixed with deionized water having an electroconductivity not greater than 1 $\mu$S/cm and substantially the same weight as that of the solvent while agitating, the water has an electroconductivity not greater than 2 $\mu$S/cm.

35 Claims, 6 Drawing Sheets

ELECTROPHOTOGRAPHIC PHOTORECEPTOR, AND IMAGE FORMING METHOD AND APPARATUS USING THE PHOTORECEPTOR

BACKGROUND OF THE INVENTION

1. Field of the Invention

The present invention relates to an electrophotographic photoreceptor. In addition, the present invention relates to an electrophotographic image forming method and apparatus using a photoreceptor. Further, the present invention relates to a process cartridge for electrophotographic image forming apparatus, which includes a photoreceptor.

2. Discussion of the Background

As electrophotographic image forming methods, various methods using a photoreceptor such as the Carlson process and its modified processes are known and have been used for image forming apparatus such as copiers and printers. Among photoreceptors used for such image forming methods, photoreceptors using an organic photosensitive material have been currently used because of having advantages such as low manufacturing cost, good productivity and low pollution.

Specific examples of the organic photoreceptors include the photoreceptors including one of the following photosensitive layers:

(1) organic photoconductive resin layers typified by poly-N-vinylcarbazole;
(2) charge transfer complex type photosensitive layers as typified by a combination of poly-N-vinylcarbazole (PVK) with 2,4,7-trinitrofluorenon (TNF);
(3) pigment dispersion type photosensitive layers typified by a combination of phthalocyanine and a binder resin; and
(4) functionally-separated photosensitive layer typified by a combination of a charge generation material and a charge transport material.

Among these photoreceptors, the functionally-separated photoreceptors attract considerable attention now.

The electrophotographic image forming methods typically include the following processes:

(1) charging an electrophotographic photoreceptor in a dark place (charging process);
(2) irradiating the charged photoreceptor with imagewise light to form an electrostatic latent image thereon (light irradiating process);
(3) developing the latent image with a developer including a toner mainly constituted of a colorant and a binder to form a toner image thereon (developing process);
(4) optionally transferring the toner image onto an intermediate transfer medium (first transfer process);
(5) transferring the toner image onto a receiving material such as a receiving paper ((second) transfer process);
(6) heating the toner image to fix the toner image on the receiving material (fixing process); and
(7) cleaning the surface of the photoreceptor (cleaning process).

The mechanism of forming an electrostatic latent image in the functionally-separated photosensitive layer having a charge generation layer and a charge transport layer formed on the charge generation layer is as follows:

(1) when the photosensitive layer is exposed to light after being charged, light passes through the transparent charge transport layer and then reaches the charge generation layer;
(2) the charge generation material included in the charge generation layer absorbs the light and generates a charge carrier such as electrons and positive holes;

(3) the charge carrier is injected into the charge transport layer and transported through the charge transport layer, which is caused by the electric field formed by the charge on the photosensitive layer;
(4) the charge carrier finally reaches the surface of the photosensitive layer and neutralizes the charge thereon, resulting in formation of an electrostatic latent image.

For such functionally-separated photoreceptors, a combination of a charge transport material mainly absorbing ultraviolet light and a charge generation material mainly absorbing visible light is known to be useful.

Currently, a need exists for a photoreceptor having a long life. In particular, investigation of improving mechanical durability (i.e., abrasion resistance) of photoreceptors has been mainly made. For example, new binder resins have been proposed in Japanese Patent Publication No. (hereinafter referred to as JPP) 8-20739, etc. and various photoreceptors having new construction have also been disclosed. This is because the life of a photoreceptor substantially depends on the abrasion of the photosensitive layer and does not depend on the deterioration of the electrostatic properties of the photoreceptor.

However, when the abrasion resistance of photoreceptors is improved by various methods, it is considered that there will be severe demands for improving the deterioration of electrostatic properties such as decrease of charge potential (i.e., the potential of a dark area of a photoreceptor $V_D$, hereinafter sometimes referred to as a dark area potential) and increase of residual potential (i.e., the potential of a lighted area of the photoreceptor $V_L$, hereinafter sometimes referred to as a lighted area potential) In attempting to improve the deterioration of electrostatic properties, main materials constituting organic photoreceptors, such as charge generation materials and charge transport materials, have been improved. In addition, methods such that various additives such as antioxidants are added to photoreceptors have also been proposed. However, there is a trade-off between the deteriorated electrostatic properties, i.e., the decrease of charge potential and the increase of residual potential. Therefore, there is no method for improving both the decrease of charge potential and the increase of residual potential. Therefore, a photoreceptor having good combination of high dark area potential and low residual potential is earnestly desired.

As one of measures against abrasion of photoreceptors, methods in which a protective layer is formed on a surface of a photoreceptor have been proposed. Investigation of forming a protective layer is at first made for inorganic photoreceptors and has been disclosed in, for example, JPP 2-3171, 2-7058 and 3-43618. In these cases in which a protective layer is formed on inorganic photoreceptors, a filler having a relatively low resistance is preferably used for the protective layer. Therefore, when such photoreceptors are charged, the entire protective layer or the interface between the protective layer and the inorganic photosensitive layer is typically charged rather than the surface of the photoreceptor.

When a latent image is not formed on a surface of a photoreceptor but is formed on the inside of the protective layer, the photoreceptor has an advantage such that the resultant electrostatic latent image is hardly influenced by deficiencies of the surface of the photoreceptor, such as scratches. However, in order to impart a protection function to the protective layer, a large amount of an electroconductive filler such as metal oxides has to be added to the protective layer. In such a case, even if the protective layer is made so as to be transparent by using a suitable metal oxide, the resistance of the entire protective layer or the surface resistance of the protective layer decreases, resulting in occurrence of blurred images in repeated use. In attempting to solve the blurred image problem, JPP 2-7057 and Japanese Patent No. 2,675,035 have disclosed methods in which the concentration of an electroconductive metal oxide is changed in the depth direction of the protective layer.

In addition, in attempting to solve the blurred-image problem on the process side, a device including a heater heating a photoreceptor is proposed. By heating a photoreceptor, occurrence of blurred images can be avoided. However, when a drum heater is set in the photoreceptor, the diameter of the photoreceptor has to be widened.

Currently electrophotographic image forming apparatus are miniaturized more and more and therefore photoreceptors having a small diameter are mainly used. Since this heating technique cannot be used for such photoreceptors having a small diameter, it is hard to provide small-diameter photoreceptor having good durability. In addition, when a drum heater is provided in an image forming apparatus, the apparatus has many drawbacks such that the apparatus becomes large-sized; electric power consumption seriously increases; and it takes a long time until the apparatus is warmed up.

When a protective layer including a filler having a low electric resistance is formed as a surface layer on an organic photoreceptor (a so-called OPC) including a charge generation material and a charge transport material, a problem which occurs is that the resultant images have tailing when the photoreceptor is repeatedly used. In addition, the above-mentioned method in which the concentration of an electroconductive metal oxide included in a protective layer is changed in the depth direction of the protective layer and which is useful for inorganic photoreceptors is used for OPCs, almost the same results are produced (i.e., images having tailing are produced).

The reason is not yet determined, however it is considered to be that the current image forming methods in which dot images are written according to digital signals on the surface of a photoreceptor are largely different from the old image forming methods in which an inorganic photoreceptor is typically used (i.e., in which an analogue image is formed on an inorganic photoreceptor). Namely, the level of the requirement for resolution of latent images formed on a current photoreceptor, which is required from the machine side, is largely changed, and therefore the tailing problem may be noticeable.

When such situations are taken into consideration, it is essential to use a filler having a high resistance in a surface layer of an optical photoreceptor instead of a low resistance filler. However, when a filler having a high resistance is used, a problem such that residual potential of the resultant photoreceptor increases tends to occur. When residual potential increases (i.e., the lighted-area potential of a photoreceptor in an image forming apparatus increases), the image density and the half-tone reproducibility of the resultant images deteriorate. In attempting to solve such problems, the dark-area potential should be increased. However, when the dark-area potential is increased, the electric field strength also increases, resulting in production of image defects such as background development and shortage of life of the photoreceptor.

In attempting to avoid increase of residual potential, methods in which a photoconductive protective layer is formed have been disclosed in JPPs 44-834, 43-16198 and 49-10258. However, imagewise light is absorbed by the protective layer, and therefore the quantity of light which reaches the photosensitive layer decreases, resulting in decrease of the photosensitivity of the photoreceptor. Therefore, there is little effect.

Japanese Laid-Open Patent Publication No. (hereinafter JOP) 57-30846 discloses a method in which a metal or a metal oxide having an average particle diameter not greater than 0.3 $\mu$m is included as a filler in a protective layer to prepare a transparent protective layer, resulting in prevention of increase of residual potential. However, its effect of preventing increase of residual potential is not insufficient, and therefore the problem cannot be solved.

This is because the increase of residual potential is caused by charge trapping due to the added filler and uneven dispersion of the filler rather than deterioration of charge generation efficiency. Even when a filler having an average particle diameter not greater than 0.3 $\mu$m is used, the transparency of the resultant protective layer decreases if the filler aggregates. On the contrary, when a filler having an average particle diameter not less than 0.3 $\mu$m is used, a transparent protective layer can be formed if the filler is uniformly dispersed.

In addition, JOP 4-281461 discloses a method in which a charge transport material is included in a protective layer together with a filler in attempting to prepare a photoreceptor capable of preventing increase of residual potential while having a good mechanical strength. To include a charge transport material in a protective layer improves the charge mobility and therefore the decrease of residual potential can be improved to some extent. However, when a filler is added, residual potential is remarkably increased, which is caused by the increase of resistance of the protective layer and the number of charge trap sites in the protective layer. Therefore, there is a limit to restraint of the increase of residual potential by this method the thickness of the protective layer has to be decreased or the filler content has to be decreased. Accordingly, the demand for a photoreceptor having good durability cannot be satisfied.

As other methods for curbing the increase of residual potential, a method in which a Lewis acid is included in a protective layer (JOP 53-133444); a method in which an organic proton acid is included in a protective layer (JOP 55-157748); a method in which an electron accepting material is included in a protective layer (JOP 2-4275); and a method in which a wax having an acid value of 5 mgKOH/g is included in a protective layer (JOP2000-66434), have been disclosed.

These methods improve the charge injection at the interface between the protective layer and the charge transport layer. It is considered that by these methods portions having a low resistance are formed in the protective layer, and the charge can reach the surface of the protective layer, resulting in decrease of residual potential. However, the resultant images produced by these methods tend to be blurred. In addition, when an organic acid is included in a protective layer, the dispersion of the filler in the protective layer tends to deteriorate. Thus, these methods produce adverse effects, and therefore it can be said that the problem cannot be solved.

In photoreceptors in which a filler is included to improve their durability, it is needed to avoid production of blurred images and to curb increase of residual potential, in order to produce high quality images. In addition, it is also important that charges in a photoreceptor linearly move toward the surface of the photoreceptor without being obstructed by the filler included in the protective layer. Therefore, it is needed that the filler in the protective layer is well dispersed therein. When the filler included in a protective layer agglomerates, movement of the charges injected into the protective layer from the charge transport layer are obstructed by the filler when the charges move toward the surface of the protective layer. Therefore a toner image constructed of scattered toner particles is formed, resulting in deterioration of resolution of the toner image.

In addition, when imagewise light irradiates such a protective layer including an agglomerated filler, the light is scattered by the filler, resulting in deterioration of light-transmittance, and thereby resolution of the resultant image deteriorates.

Further, the dispersion of a filler included in a protective layer largely influences the abrasion resistance of the photoreceptor. When a filler seriously agglomerates (i.e., a filler is poorly dispersed), the abrasion resistance of the resultant photoreceptor deteriorates. Therefore in order to provide a photoreceptor in which a filler is included in a protective layer to improve the durability of the photoreceptor and which can produce high quality images, it is important not only to prevent occurrence of blurred images and increase of residual potential but also to improve dispersion of the filler in the protective layer.

However, a solution by which these problems are solved at the same time has not been discovered. Namely, when a filler is included in a surface layer of a photoreceptor to improve its durability, blurred images tend to be produced and residual potential tend to increase, and therefore a problem in that high quality images cannot be obtained remains. As mentioned above, a drum heater should be provided in an image forming apparatus to improve such a problem. However, a drum heater cannot be installed in a small-sized photoreceptor, which is earnestly desired to have good durability. Therefore there is no small photoreceptor having good durability and capable of producing high quality images. To install a drum heater is an obstruction to miniaturized image forming apparatus and image forming apparatus having low electric power consumption.

Currently organic photoreceptors have advantages against inorganic photoreceptors, such as high photosensitivity, wide spectral photosensitivity, low pollution, and good electrostatic durability. In order to make full use of such advantages, the mechanical durability and electrostatic durability of the organic photoreceptors have to be improved. In addition, in order to develop an image forming apparatus having good durability, a photoreceptor which can produce high quality images while having good durability is especially desired.

SUMMARY OF THE INVENTION

Accordingly, an object of the present invention is to provide a photoreceptor which can produce high quality images and which has good durability. Specifically, an object of the present invention is to provide a stable photoreceptor which has good mechanical durability and electrostatic durability (i.e., increase of residual potential and occurrence of blurred images can be curbed) and which can produce high quality images even in repeated use.

Another object of the present invention is to provide a photoreceptor which has stable photosensitive properties even when environmental conditions such as temperature and humidity change and which is resistant to reaction gases such as ozone and NOx.

Yet another object of the present invention is to provide an image forming method which uses the photoreceptor mentioned above and by which high quality images can stably produced for a long period of time.

A further object of the present invention is to provide a small-sized image forming apparatus and a process cartridge by which high quality images can be stably produced for a long period of time without frequently changing the photoreceptor.

Briefly these objects and other objects of the present invention as hereinafter will become more readily apparent can be attained by an electrophotographic photoreceptor including at least an electroconductive substrate, a photosensitive layer formed on the substrate and a protective layer formed on the photosensitive layer and including a binder resin, wherein when a solution in which the binder resin is dissolved in an organic solvent incompatible with water is mixed with deionized water having an electroconductivity not greater than 1 $\mu$S/cm and substantially the same weight as that of the solvent while being agitated, the water has an electroconductivity not greater than 2 $\mu$S/cm.

It is preferable that the binder resin is previously subjected to a refinement treatment such as washing treatments using an alkali and/or an acid to remove ionic impurities therefrom.

The binder resin preferably includes a polycarbonate resin.

The protective layer (i.e., the surface layer) preferably includes a filler. The filler is preferably an inorganic pigment having a specific resistance not less than $10^{10}$ $\Omega$·cm. The inorganic pigment is preferably a metal oxide selected form the group consisting of silica, alumina and titanium oxide.

The pH and dielectric constant of the inorganic pigment are preferably not less than 5 and not less than 5, respectively. The surface of the inorganic pigment is preferably subjected to a treatment preferably using a material selected from the croup consisting of titanate coupling agents, aluminum coupling agents, higher fatty acids, alumina, titanium dioxide and zirconium dioxide, and their mixtures and their mixtures with a silane coupling agent with at least one of the materials mentioned above. The ratio (Ws/Wf) of a weight (Ws) of the surface treating agent to a weight (Wf) of the filler is from 0.03 to 0.30. The primary particle diameter of the filler is preferably form 0.01 to 0.5 $\mu$m.

The protective layer preferably includes a charge transport material. The charge transport material is preferably a charge transport polymer material such as polycarbonate resins having a triarylamine structure in its main and/or side chain.

The polycarbonate resin preferably has a repeating unit having the following formula (A) or (B):

(A)

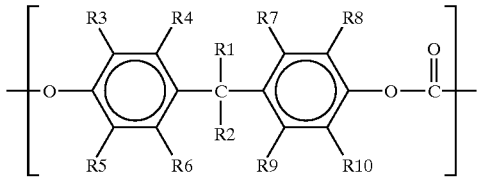

wherein R1 and R2 independently represent a hydrogen atom, a substituted or unsubstituted aliphatic group, a substituted or unsubstituted carbon ring or a substituted or unsubstituted aromatic group; and R3 to R10 independently represent a hydrogen atom, a halogen atom, a substituted or unsubstituted aliphatic group or a substituted or unsubstituted carbon ring, and (B)

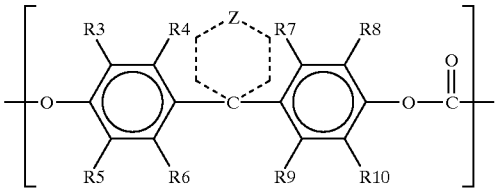

wherein R3 to R10 independently represent a hydrogen atom, a halogen atom, a substituted or unsubstituted aliphatic group or a substituted or unsubstituted carbon ring; and Z represents a substituted or unsubstituted carbon ring or an atom group needed for forming an unsubstituted heterocyclic group.

The repeating unit is preferably one of the following repeating units (1) to (3):

(1)

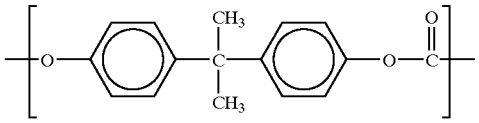

(2)

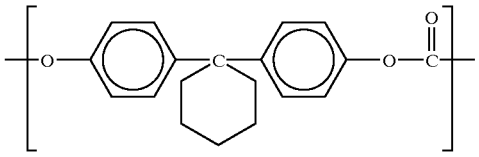

(3)

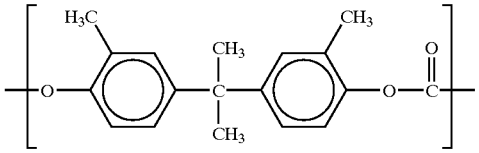

In another aspect of the present invention, an image forming method is provided which includes the steps of charging the photoreceptor of the present invention, irradiating the charged photoreceptor with light to form an electrostatic latent image, developing the latent image with a developer to form a toner image on the photoreceptor, and transferring the toner image onto a receiving material. The light irradiation process is preferably digitally performed (i.e., dotted light images are formed on the photoreceptor by irradiating a light beam) using a laser diode (LD) or a light emitting diode (LED) as a light source.

The image forming method preferably further includes a step of applying zinc stearate on the surface of the photoreceptor. In addition, the toner preferably includes zinc stearate. Further, it is preferable that when the above-mentioned image forming process are not performed, a cleaning process including the steps of adhering the toner on the surface of the photoreceptor at the developing section and collecting the toner at the cleaning section is performed.

In yet another aspect of the present invention, an image forming apparatus is provided which includes the photoreceptor of the present invention, a charger configured to charge the photoreceptor, a light irradiator configured to irradiate the charged photoreceptor with light to form an electrostatic latent image thereon, an image developer configured to develop the latent image with a developer to form a toner image thereon, and a transfer device configured to transfer the toner image onto a receiving material.

Preferably the charger is a contact charger or a proximity charger. A DC voltage overlapped with an AC voltage is preferably applied to the charger. It is preferable that the light irradiator digitally writes light images using a laser diode (LD) or a light emitting diode (LED) as a light source. Further it is preferable that the image forming apparatus further has a lubricant applicator applying a lubricant such as stearic acid to the photoreceptor.

In a further aspect of the present invention, a process cartridge for an image forming apparatus is provided which includes the photoreceptor of the present invention, a housing and at least one of a charger, an image irradiator, an image developer, an image transferee, a cleaner and a discharger.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
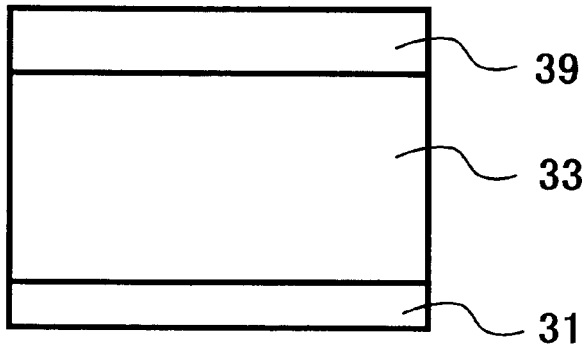
FIG. 1 is a schematic view illustrating the cross section of an embodiment of the photoreceptor of the present invention.

The present inventor has investigated why the electrostatic properties of photoreceptors deteriorate when repeatedly used or when used in an atmosphere including reactive gases such as ozone and NOx. As a result, the properties can be improved to some extent by improving the main components of the photoreceptors, such as charge generation materials and charge transport materials. Namely, by changing the skeleton and/or physical properties of the main components, the electrostatic properties of the photoreceptors can be improved to some extent. The present inventor discovers that the purity of such main components largely influences the electrostatic properties. Among the main components, the content of the binder resin in the photoreceptor is about 50% or more based on total weight of the layers such as the photosensitive layer and the protective layer. Conventionally the binder resins have been improved while paying attention to their mechanical properties, but the purity of the binder resins has not been investigated.

The present inventor has investigated purity, refinement methods, etc. of the binder resins constituting photoreceptors. As a result, it is discovered that by removing ionic impurities from the binder resins included in a photoreceptor, the electrostatic properties of the photoreceptor can be dramatically improved, and specifically decrease of dark-area potential of the photoreceptor and increase of residual potential thereof can be curbed.

Purity and refinement methods of binder resins used for photoreceptors have been disclosed in JOPs 7-84377 and 10-133405.

It is disclosed in JOP 7-84377 that a polycarbonate resin including free chlorine in an amount not greater than 2 ppm is used in the photosensitive layer. Typical polycarbonate resins include free chlorine in an amount of from about 2 to 10 ppm. When a polycarbonate resin including free chlorine in a large amount is used in a photosensitive layer, a problem which occurs is that undesired small black spot images (or pinholes in solid images) are formed. JOP 7-84377 discloses that by using the polycarbonate resin mentioned above is used, such a problem can be avoided.

The photoreceptor disclosed in JOP 7-84377 has a structure in which a photosensitive layer is formed on a substrate or a layered structure in which a charge generation layer and a charge transport layer are formed on a substrate as a photosensitive layer. In such photoreceptors, the photosensitive layer is largely abraded when repeatedly used. Therefore, the undesired images such as blurred images, which are typical of the photoreceptors including a protective layer, are not produced. Namely, JOP 7-84377 does not refer to the problem to be occurred when photoreceptors including a protective layer are used. The object of the present invention is to provide a photoreceptor which includes a protective layer and which does not cause such a problem.

It is disclosed in JOP 7-84377 that the photoreceptor may include a protective layer. However, there is no description about the specific polycarbonate mentioned above, and therefore it is not clear whether the above-mentioned problem of the photoreceptor having a protective layer can be solved.

In the examples disclosed in JOP 7-84377, the electroconductivity of the aqueous layer formed when refining a polycarbonate resin is measured. The specific data of the electroconductivity are 4.4, 3.5, 3.9 and 12.7 $\mu$S/cm. These data are almost the same as those of Comparative Examples in the present application mentioned below. As mentioned below, when such polycarbonate resins are used for a photoreceptor, the resultant photoreceptor cannot solve the problem, i.e., production of blurred images cannot be avoided.

In other words, in order to solve the blurred-image problem, it is needed that the polycarbonate resins should be treated by a higher-level refinement treatment than that of the refinement treatment disclosed in JOP 7-84377. It can be said that even when the polycarbonate resins disclosed in JOP 7-84377 are used in a protective layer, the blurred image problem cannot be solved.

In addition, the blurred-image problem is caused by various ionic impurities included in the resin included in the protective layer. As a result of the present inventor's investigation, various materials having low electric resistance, which are salts formed of ions added to the photoreceptors from outside, are detected from the photoreceptors. Therefore it is considered that cations and anions serves as trap sites or absorption sites. Accordingly there is no effect if only the quantity of free chlorine is decreased.

JOP 10-133405 discloses a charge transport polymer material, whose degree of refinement is represented by pH, and a photoreceptor using the charge transport polymer. Specifically JOP 10-133405 discloses that the properties of a photoreceptor are influenced by the purity of the charge transport material included in the photoreceptor and the refining methods useful for low molecular weight materials cannot be applied to polymer materials. It also discloses that by using a charge transport polymer material, which has been refined such that the pH of the extracted solution in the refinement process falls in a specific range, in a photoreceptor, the resultant photoreceptor has stable electric properties.

When such a charge transport polymer material as disclosed in JOP 10-133405 is used in a charge transport layer, the charge transport layer has better abrasion resistance than that of a charge transport layer in which a low molecular weight charge transport material is dispersed in a polymer (this charge transport layer is sometimes referred to as a MDP layer).

Charge transport polymer materials have a group having a charge transport function in their main chain or side chain. In particular, as disclosed in JOP 10-133405, a triphenyl amine structure is useful for the charge transport polymer materials. The triphenyl amine structure is a propeller structure whose center is a nitrogen atom, and is very bulky. Therefore such a charge transport polymer layer has a relatively high abrasion resistance compared to MDP layers. However, as disclosed in JOPs 9-311479 and 9-311487, the abrasion resistance of the charge transport polymer layer is at most about twice that of MDP layers.

Of course, it is possible to reduce the content of the charge transport group, to improve the abrasion resistance of the resultant charge transport layer. However, by using this method, the charge transport ability of the charge transport layer is deteriorated, similarly to the case in which the content of a low molecular weight charge transport material included in a MDP layer is decreased, and thereby problems such that the mobility is decreased and residual potential increases occur. Therefore this method is not useful.

When the photoreceptor disclosed in JOP 10-133405 and including a charge transport polymer material in the charge transport layer is practically used, the abrasion decreases. However, the photoreceptor is still abraded fairly so that the blurred image problem does not occur. Accordingly it is not clear whether the blurred image problem can be prevented when the charge transport polymer material disclosed in JOP 10-133405 is used in a protective layer.

In the examples of JOP 10-133405, the electroconductivity of the aqueous solution used for the washing treatment of the charge transport polymer material ranges from 2.30 to 8.69 $\mu$S/cm. In addition, in the examples the quantity of deionized water added to a methylene chloride solution of the charge transport polymer material is 4 times the quantity of the methylene chloride used for dissolving the charge transport polymer material. In contrast, in the electroconductivity determining method in the present application, the quantity of deionized water added is the same as that of the solvent dissolving a binder resin. Therefore, the conductivity (2.30 to 8.69 $\mu$S/cm) in JOP 10-133405 has to be multiplied by 4 when comparing with the electroconductivity in the present application. Namely the conductivity of the aqueous solution in the examples in JOP 10-133405 is from about 8 to 30 μS/cm. These data are almost the same as those of Comparative Examples of this application.

Therefore even if such a charge transport polymer material is used for a protective layer, the blurred image problem cannot be solved. In other words, in order to solve the problem, it is needed that the charge transport polymer materials should be treated by a higher level refinement treatment than that of the refinement treatment disclosed in JOP 10-133405.

In addition, the degree of refinement of the charge transport polymer materials is judged based on the pH of the aqueous solution. Namely, this method takes into consideration of water-soluble basic impurities in the aqueous solution. Certainly such water-soluble basic impurities cause the increase of residual potential of a photoreceptor in which positive holes are used as a carrier. However, the blurred image problem is caused by basic and acidic impurities. Therefore, it is impossible to avoid the blurred image problem by controlling the concentration of only the basic impurities.

The reason why the deterioration of the electrostatic properties of a photoreceptor in repeatedly use or in use in an atmosphere including reactive gases can be improved by refining the binder resin (i.e., by removing ionic impurities from the binder resin) is not yet determined. However, the reason is considered to be as follows.

When a photoreceptor is exposed to imagewise light, the photosensitive layer absorbs the light and generates photo-carriers. The thus generated photo-carriers pass through the photosensitive layer toward the surface or toward the substrate, and finally neutralize the charges (or the charges induced by the charges), resulting in fulfillment of the functions. With respect to these functions, the binder resin is not concerned with generation of photo-carriers but plays an important role of transporting the photo-carriers.

In OPCs, the carrier transportation is substantially made by hopping conduction. Cation radicals (when positive holes are transported) or anion radicals (when electrons are transported) move through the photosensitive layer while exchanging holes or electrons. Therefore it is very important for the binder resin, which is not concerned with charge transportation, to be electrically neutral when charges are transported. In other words, when ionic impurities are included in a binder resin, carriers having a polarity opposite to the polarity of the ionic impurities are trapped by the impurities. Therefore it is considered that to avoid such trapping is very effective against increase of residual potential. Such ionic impurities move through the photosensitive layer along the electric field formed on the photosensitive layer when repeatedly used, and therefore weak points in the photosensitive layer tend to be damaged by the impurities, resulting in acceleration of deterioration of the constituents of the photosensitive layer.

The electrostatic properties of a photoreceptor are deteriorated when the photoreceptor is repeatedly used or when the photoreceptor is used in an atmosphere including reactive gases. In the former case, the deterioration is caused by a phenomenon in which carriers trapped in the photosensitive layer before charging are discharged when the photosensitive layer is charged, or a phenomenon in which heat carriers are generated due to the electric field formed when the photosensitive layer is charged. It is considered that the ionic impurities trigger the trapping of the carriers and the generation of the heat carriers.

In the latter case, when a photoreceptor is exposed to reactive gasses, the constitutional materials of the photosensitive layer deteriorate. This deterioration cannot be explained only by the gas-transmittance of the materials, and it is considered that there are any absorption sites in the photosensitive layer, which absorb the reactive gasses. With respect to this phenomenon, the moisture of the photosensitive layer cannot be neglected. The ionic impurities have high affinity to water and the reactive gasses. Therefore, it is considered that by sufficiently removing such impurities, the deterioration of the electrostatic properties can be avoided.

In order that the life of a photoreceptor is not determined depending on its abrasion, the mechanical durability of the photoreceptor (i.e., abrasion resistance) has to be also improved. From this viewpoint, a photoreceptor in which the abrasion resistance of its photosensitive layer is improved only by improving the binder resin cannot meet the requirement (i.e., long life requirement) for the photoreceptors for use in the current image forming apparatus. Therefore, the photoreceptor for use in the current image forming apparatus has to have a protective layer on the surface thereof.

In the present invention, the protective layer is formed overlying the photosensitive layer to protect the photosensitive layer from mechanical hazards and abrasion. Therefore, the protective layer has abrasion resistance better than the MDP-type charge transport layer and the charge transport layer including a charge transport polymer.

In general, the abrasion of the protective layer, which depends on the image forming system used, is not greater than one half of that of the MDP charge transport layer and the charge transport layer including a charge transport polymer material. For example, when a typical cylindrical photoreceptor which has a diameter of 30 mm and which includes a MDP charge transport layer as a surface layer is used, the abrasion of the layer is about 1.5 to 2 μm when 10,000 receiving materials of A4 size are fed to form toner images. In contrast, when the photoreceptor having a protective layer of the present invention is used, the abrasion is not greater than about 0.5 μm and preferably not greater than 0.3 μm.

Various protective layers are known. When the life of a current organic photoreceptor in view of electrostatic properties is compared with the life thereof in view of abrasion resistance, a photoreceptor for use in such current image forming apparatus as mentioned above preferably has abrasion resistance at least several times the abrasion resistance of the MDP-layer type photoreceptors, which are mainly used for electrophotographic image forming apparatus now. In other words, photoreceptors which include a charge transport polymer material and have abrasion resistance about twice the abrasion resistance of the MDP-layer type photoreceptors are not satisfactory to the current image forming apparatus.

In the present invention, the target of the abrasion resistance of the protective layer is not less than several times (preferably not less than 5 times) the abrasion resistance of the MDP-layer type photoreceptors. Specific examples of the protective layer having such good abrasion resistance as mentioned above are as follows:

(1) A protective layer constituted of a charge transport polymer and a binder resin which is electrically inactive (i.e., a binder resin not having charge transportability).

In this case, when the electrically inactive resin is included in a too large amount, the charge transportability of the protective layer deteriorates, resulting in occurrence of problems such as decrease of the photosensitivity and increase of residual potential.

(2) A protective layer constituted of a binder resin and a charge transport polymer or its precursor, which are crosslinked.

In this case, the precursor is a compound having a group capable of performing a crosslinking reaction. It is especially preferable that the crosslinked compound has a charge transport moiety.

(3) A protective layer constituted of a binder resin and a filler dispersed in the binder resin.

In this case, the binder resin may be an electrically inactive polymer or a charge transport polymer.

Among these protective layers, the third protective layer is preferably used for organic photoreceptors. However, as mentioned above, the techniques which have been used for conventional inorganic photoreceptors cannot be necessarily used for organic photoreceptors.

Namely, when a protective layer is formed on an organic photosensitive layer, a filler is typically included to impart good abrasion resistance to the resultant photoreceptor. However, when a material having a low specific resistance (i.e., an electroconductive material), which is typically used for inorganic photoreceptors, is used for organic photoreceptors, undesired images such as blurred images and tailing are produced from the start or in repeated use. Therefore it is needed to use a filler having a relatively high specific resistance.

However, when a filler having a relatively high specific resistance is used, production of such undesired images can be avoided but another problem such that the residual potential increases occurs.

Conventional inorganic photoreceptors are used for positive charging methods whether they have a protective layer or not. With respect to the charge transport materials for use in organic photoreceptors, positive hole transport materials and electron transport materials have been investigated. However, only the hole transport materials have been practically used. Therefore almost all the current functionally-separated organic photoreceptors are used for negative charging methods to deliver their good performance. There are several photoreceptors having a single-layered photosensitive layer or a contrary structure in which a charge transport layer formed on a charge generation layer, but these photoreceptors are not main.

The reason why the techniques of the protective layers for inorganic photoreceptors cannot be applied to organic photoreceptors is considered to be that the polarity of charges formed on the organic photoreceptors is different from that on the inorganic photoreceptors. The dark-area potential of organic photoreceptors is almost the same as that of inorganic photoreceptors although the polarity is different. With respect to the charging efficiency of chargers, the charging efficiency of positive charging is higher than that of negative charging.

In addition, the quantity of reactive gasses generated by negative charging is much greater than the quantity of reactive gasses when positive charging is performed. It is considered that the blurred image problem is caused by decrease of the surface resistance of the photoreceptor. In addition, it is known that the surface resistance is decreased mainly by the materials having low resistance which are formed by the reactive gasses and which adhere on the surface of the photoreceptor.

In order to solve this problem, contact charging methods have been disclosed. It is certain that the concentration of ozone present near the contact chargers is relatively low compared to that when conventional chargers (i.e., non-contact chargers) are used. However, as a result of the present inventor's investigation, the quantity of low-resistance materials adhered on the surface of a photoreceptor charged by a contact charger is almost the same as that when charged by a non-contact charger. The reason for this result is considered to be that when a contact charger is used, the generated low-resistance materials are forcibly adhered to the surface of the photoreceptor and the adhered low-resistance materials cannot be released from the surface because there is no airflow between the charger and the photoreceptor.

As can be understood from the investigation result mentioned above, when a surface layer is formed on a photoreceptor used for negative charging, it is essential to use a filler having high specific resistance in the surface layer. Therefore a protective layer different from the protective layers used for conventional inorganic photoreceptors should be formed on organic photoreceptors.

Namely, in order to provide a photoreceptor having excellent durability, the following is needed:

(1) to avoid deterioration of charge properties of a photoreceptor (i.e., decrease of dark-area potential) in repeated use while preventing increase of residual potential (i.e., increase of lighted-area potential); and (2) to avoid of occurrence of undesired images such as blurred images and low density images, which are caused by forming a protective layer to improve the abrasion resistance of the photoreceptor.

There are following three trade-offs in the above-mentioned two subjects:

(A) a trade-off between deterioration of charge properties and increase of residual potential These problems are caused by phenomena occurring in the whole photosensitive layer and protective layer or the interface therebetween. A measure such as changes of materials used or layer construction for solving one of the problems worsens the other problem.

(B) a trade-off between improvement of abrasion resistance and decrease of residual potential The decrease of residual potential of a photoreceptor is caused by a filler added in the protective layer to improve the abrasion resistance of the photoreceptor or the impurities which is included in a binder resin in the protective layer and which obstruct transportation of charge carriers through the protective layer due to increase of the bulk resistance of the protective layer and increase of the number of trap sites therein.

(C) a trade-off between improvement of abrasion resistance and prevention of blurred image When the abrasion resistance of the surface layer is improved, low-resistance materials caused by reactive gasses generated by chargers adhere on the surface layer without being removed therefrom, resulting in decrease of the surface resistance of the surface layer.

As a result of the present inventor's investigation of the above-described three problems (trade-offs), it is found that they are concerned with internal or external ionic impurities. Namely, by using a binder resin, from which ionic impurities are removed in the extreme, for a protective layer and/or a photosensitive layer, the three problems can be solved at the same time. Namely, a photoreceptor which has good durability and can produce good images in long repeated use can be provided. In addition, an image forming method and apparatus, and a process cartridge by which good images can be stably produced for a long period of time can be provided. Thus the present invention is made.

According to the present invention, an electrophotographic photoreceptor including at least an electroconductive substrate, a photosensitive layer formed on the substrate and a protective layer formed on the photosensitive layer and including a binder resin, wherein when a solution in which the binder resin is dissolved in an organic solvent incompatible with water is mixed with an deionized water having an electroconductivity not greater than 1 $\mu$S/cm and substantially the same volume as that of the solvent while being shaken, the water has an electroconductivity not greater than 2 $\mu$S/cm.

The binder resin is preferably subjected to a refinement treatment such as washing treatments using an alkali and/or an acid to remove ionic impurities therefrom.

The reaction due to impurities adhered on a photoreceptor, which causes residual potential to increase, occurs at first at the surface of the photoreceptor. In a photoreceptor having no protective layer, even when such a reaction occurs at the surface of the photosensitive layer, the damaged surface portion of the photosensitive layer is easily abraded in repeated use and therefore the above-mentioned undesired images are hardly produced. However, when the abrasion resistance is improved by forming a protective layer (i.e., the abrasion speed of the surface of the photoreceptor is decreased), the electrostatic properties of the photoreceptor remarkably deteriorate (i.e., residual potential increases and dark-area potential decreases).

In addition, when the surface of the photoreceptor is charged, which is an essential process of electrophotographic image forming methods, reactive gasses are generated and low-resistance materials are formed on the surface due to the reactive gasses. Such low-resistance materials are removed when the surface of the photoreceptor is easily abraded, resulting in occurrence of no problem. However, when the surface is hardly abraded, blurred images are produced by such a photoreceptor.

This phenomenon also relates to the impurities included in the protective layer, and it is considered that the chemical deterioration of the surface is caused for the same reason as mentioned above.

In contrast, with respect to the blurred image problem, it has been considered that the reactive gasses generated by chargers form low-resistance materials by contacting moisture included in an atmosphere surrounding the photoreceptor. The low-resistance materials deposits on the surface of the photoreceptor, and thereby the surface resistance of the photoreceptor decreases. However, there has been no discussion about adsorption sites. Namely, a solution of preventing such low-resistance materials from being adsorbed on the adsorption sites has not been investigated.

As a result of the present inventor's investigation of the binder resin which is included in a protective layer in an amount of not less than 50% by volume, it is found that by decreasing the quantity of the ionic impurities included in the binder resin, occurrence of the blurred images can be substantially prevented. Therefore, it is considered that the generated low-resistance materials are adsorbed by the ionic impurities present on the surface of the photoreceptor or the low-resistance materials are generated due to the ionic impurities.

Although the mechanism is not clarified, by a binder resin from which ionic impurities are removed in the extreme is used in a protective layer, the three problems (trade-offs) mentioned above can be solved at the same time.

Next, the method how to refine the binder resin will be explained.

An example of the refinement method is as follows, but the refinement method is not limited thereto and known methods can be used if the binder resin can be purified as mentioned above.

A binder resin to be used is dissolved in an organic solvent which is incompatible with (i.e., cannot be mixed with) or hardly compatible with deionized water. The solution is mixed with an aqueous alkali solution (e.g., a solution in which sodium hydroxide or potassium hydroxide is dissolved in deionized water) while agitating. The mixture is contained in a separating funnel to separate the organic layer from the aqueous layer. The thus prepared organic layer (i.e., the mixture of the binder resin and the organic solvent) is washed with deionized water and then heated to obtain a dried binder resin.

In this method, the aqueous alkali solution may be replaced with an aqueous acid solution (e.g., chloric acid, acetic acid, etc.). In addition, the washed organic layer may be added to a solvent, which cannot dissolve the binder resin, to precipitate the resin.

Thus the binder resin is purified. It is preferable that the suitable refinement method is experimentally determined such that the binder resin to be used can be purified as mentioned above. Namely, when a solution in which the thus purified binder resin is dissolved in an organic solvent incompatible with water is mixed with deionized water having an electroconductivity not greater than 1 $\mu$S/cm while being agitated and the conductivity of its water layer is almost the same as the conductivity of deionized water (i.e., not greater than 2 $\mu$S/cm), it can be said that the binder resin is fully purified.

Next, the photoreceptor of the present invention will be explained referring to drawings.

FIG. 1 is a schematic view illustrating the cross section of an embodiment of the photoreceptor of the present invention.

In FIG. 1, a single-layer photosensitive layer 33 including a charge generation material and a charge transport material as main components is formed on an electroconductive substrate 31. In addition, a protective layer 39 is formed on the surface of the photosensitive layer 33. The protective layer 39 includes a binder resin from which ionic impurities are removed in the extreme.

Figure 2:
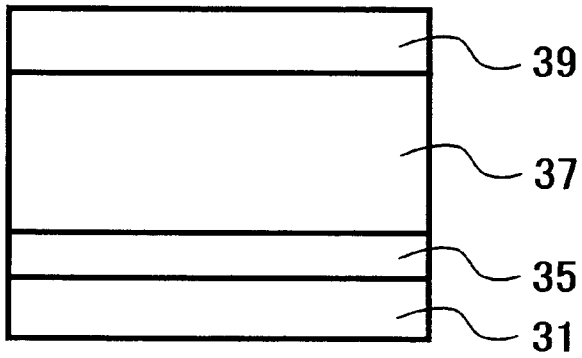
FIG. 2 is a schematic view illustrating cross section of another embodiment of the photoreceptor of the present invention.

FIG. 2 is a schematic view illustrating the cross section of another embodiment of the photoreceptor of the present invention.

In FIG. 2, a charge generation layer 35 including a charge generation material as a main component and a charge transport layer 37 including a charge transport material as a main component are overlaid on an electroconductive substrate 31. In addition, a protective layer 39 is formed on the charge transport layer 37. The protective layer 39 includes a binder resin from which ionic impurities are removed in the extreme.

Suitable materials for use as the electroconductive substrate 31 include materials having a volume resistance not greater than $10^{10}$ $\Omega$·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like, which have been disclosed, for example, in Japanese Laid-Open Patent Publication No. 52-36016, can also be used as the substrate 31.

Furthermore, substrates, in which a coating liquid including a binder resin and an electroconductive powder is coated on the supporters mentioned above, can be used as the substrate 31. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate 31.

Next, the photosensitive layer 33 of the photoreceptor of the present invention will be explained.

In the present invention, the photosensitive layer may be a single-layered photosensitive layer or a multi-layered photosensitive layer.

At first, the multi-layered photosensitive layer including the charge generation layer 35 and the charge transport layer 37 will be explained.

The charge generation layer 35 (hereinafter referred to as the CGL 35) includes a charge generation material as a main component. In the CGL 35, known charge generation materials can be used. Specific examples of such charge generation materials include monoazo pigments, disazo pigments, trisazo pigments, perylene pigments, perynone pigments, quinacridone pigments, quinone type condensed polycyclic compounds, squaric acid type dyes, phthalocyanine pigments other than the TiOPc of the present invention, naphthalocyanine pigments, azulenium salt type dyes, and the like pigments and dyes. These charge generation materials can be used alone or in combination.

Among these charge generation materials, azo pigments and/or phthalocyanine pigments are preferably used. In particular, titanyl phthalocyanine having an X-ray diffraction spectrum in which a highest peak is observed at Bragg 2 θ angle of 27.2°±0.2° when a specific X-ray of Cu—Kα having a wavelength of 1.541 Å irradiates the titanyl phthalocyanine pigment; and azo pigments having the following formula (4), are preferably used.

(4)

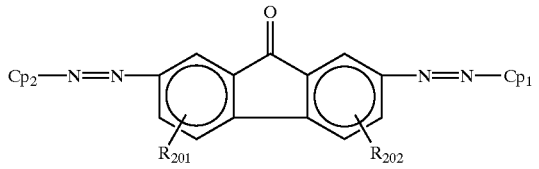

wherein $R_{201}$ and $R_{202}$ independently represent a hydrogen atom, a halogen atom, an alkyl group, an alkoxyl group, or a cyano group; and $Cp_1$ and $Cp_2$ independently represent a residual group of a coupler, which has the following formula (5):

(5)

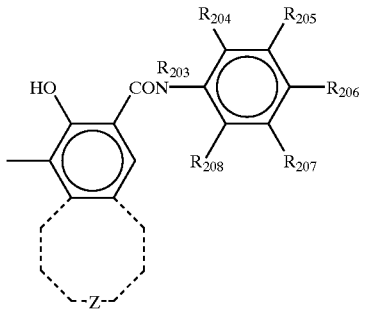

wherein $R_{203}$ represents a hydrogen atom, an alkyl group such as a methyl group and an ethyl group, or an aryl group such as a phenyl group; $R_{204}$, $R_{205}$, $R_{206}$, $R_{207}$ and $R_{208}$ independently represent a hydrogen atom, a nitro group, a cyano group, a halogen atom such as a fluorine atom, a chlorine atom, a bromine atom and an iodine atom, an alkyl group such as a trifluoromethyl group, a methyl group and an ethyl group, an alkoxyl group such as a methoxy group and an ethoxy group, a dialkylamino group or a hydroxyl group; and Z represents an atomic group needed for constituting a substituted or unsubstituted aromatic carbon ring or a substituted or unsubstituted aromatic heterocyclic ring.

The CGL 35 can be prepared, for example, by the following method:

(1) a charge generation material is mixed with a proper solvent optionally together with a binder resin;
(2) the mixture is dispersed using a ball mill, an attritor, a sand mill or a supersonic dispersing machine to prepare a coating liquid; and
(3) the coating liquid is coated on an electroconductive substrate and then dried to form a charge generation layer.

Suitable binder resins, which are optionally mixed in the charge generation layer coating liquid, include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in CGL 35 is preferably from 0 to 500 parts by weight, and preferably from 10 to 300 parts by weight, per 100 parts by weight of the charge generation material included in the CGL 35.

Suitable solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used.

The CGL coating liquid can be coated by a coating method such as dip coating, spray coating, bead coating, nozzle coating, spinner coating and ring coating. The thickness of the CGL 35 is preferably from 0.01 to 5 μm, and more preferably from 0.1 to 2 μm.

The charge transport layer 37 (hereinafter referred to as a CTL 37) can be formed, for example, by the following method:

(1) a charge transport material and a binder resin are dispersed or dissolved in a proper solvent to prepare a CTL coating liquid; and (2) the coating liquid is coated on the CGL 35 and dried to form a charge transport layer.

The CTL 37 may include additives such as plasticizers, leveling agents, antioxidants and the like if desired.

Charge transport materials are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-y-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, a-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These charge transport materials can be used alone or in combination.

Specific examples of the binder resin for use in the CTL 37 include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

It is preferable that these resins are used for the CTL 37 after ionic impurities are removed therefrom.

The content of the charge transport material in the CTL 37 is preferably from 20 to 300 parts by weight, and more preferably from 40 to 150 parts by weight, per 100 parts by weight of the binder resin included in the CTL 37. The thickness of the CTL 37 is preferably not greater than 25 μm in view of resolution of the resultant images and response (i.e., photosensitivity). In addition, the thickness of the CTL 37 is preferably not less than 5 μm in view of charge potential. The lower limit changes depending on the image forming system for which the photoreceptor is used.

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The charge transport layer 37 may include additives such as plasticizers and leveling agents. Specific examples of the plasticizers include known plasticizers, which are used for plasticizing resins, such as dibutyl phthalate, dioctyl phthalate and the like. The addition quantity of the plasticizer is 0 to 30% by weight of the binder resin included in the CTL 37.

Specific examples of the leveling agents include silicone oils such as dimethyl silicone oil, and methyl phenyl silicone oil; polymers or oligomers including a perfluoroalkyl group in their side chain; and the like. The addition quantity of the leveling agents is 0 to 1% by weight of the binder resin included in the CTL 37.

Next, the single-layered photosensitive layer 33 as shown in FIG. 1 will be explained. The photosensitive layer 33 can be formed by coating a coating liquid in which a charge generation material, a charge transport material and a binder resin are dissolved or dispersed in a proper solvent, and then drying the coated liquid. In addition, the photosensitive layer 33 may include the charge transport material mentioned above to form a functionally-separated photosensitive layer. The photosensitive layer 33 may include additives such as plasticizers, leveling agents and antioxidants.

Suitable binder resins for use in the photosensitive layer 33 include the resins mentioned above for use in the charge transport layer 37. The resins mentioned above for use in the charge generation layer 35 can be added as a binder resin. In addition, the charge transport polymer materials mentioned above can also be used as a binder resin. In particular, it is preferable that these resins and charge transport polymer materials are purified such that ionic impurities are removed therefrom before they are used as the binder resin.

The content of the charge generation material is preferably from 5 to 40 parts by weight per 100 parts by weight of the binder resin included in the photosensitive layer 33. The content of the charge transport material is preferably from 0 to 190 parts, and more preferably from 50 to 150 parts by weight, per 100 parts by weight of the binder resin included in the photosensitive layer 33.

The single-layered photosensitive layer 33 can be formed by coating a coating liquid in which a charge generation material and a binder and optionally a charge transport material are dissolved or dispersed in a solvent such as tetrahydrofuran, dioxane, dichloroethane, cyclohexane, etc. by a coating method such as dip coating, spray coating, bead coating, and the like. The thickness of the photosensitive layer 33 is preferably from 5 to 25 μm.

In the photoreceptor of the present invention, an undercoat layer may be formed between the substrate 31 and the photosensitive layer (i.e., the photosensitive layer 33 in FIG. 1, and the charge generation layer 35 in FIG. 2).

The undercoat layer includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0 to 5 $\mu$m.

In the photoreceptor of the present invention, the protective layer 39 is formed overlying the photosensitive layer (i.e., the photosensitive layer 33 in FIG. 1, and the charge transport layer 37 in FIG. 2) to protect the photosensitive layer.

As mentioned above, the construction of the protective layer is broadly classified into the following three types:

(1) a protective layer constituted of a charge transport polymer material and an electrically inactive binder resin (i.e., a binder resin not having a charge transportability) having good abrasion resistance;

(2) a protective layer constituted of a binder resin and a charge transport polymer material or its precursor, which are crosslinked; and (3) a protective layer constituted of a binder resin and a filler dispersed in the binder resin.

Suitable materials for use in the protective layer 39 include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like.

Among these resins, polycarbonate resins including a repeating unit having formula (A) and/or formula (B) mentioned above are preferably used. In particular, polycarbonate resins including a repeating unit having formula (1), (2) or (3) mentioned above are preferably used.

These binder resins can be used alone or in combination. As mentioned above, it is preferable that these resins are purified such that ionic impurities are removed in the extreme when used as the binder resin. Whether ionic impurities are removed from a resin in the extreme can be judged by the evaluation method mentioned above in which a solution prepared by dissolving the resin in an organic solvent which is not mixed with water is mixed with deionized water while being agitated, and the electroconductivity of the water layer of the mixture is measured.

Specific examples of the compounds having formula (1) include the compounds as shown in Table 1.

TABLE 1

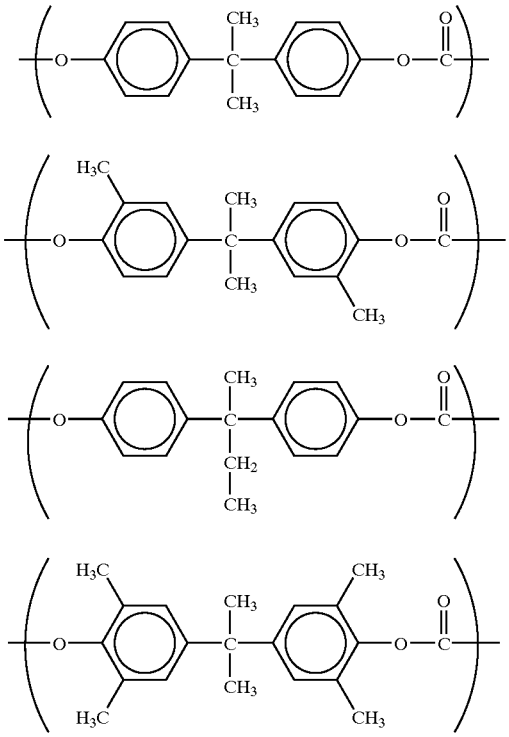

TABLE 1-continued
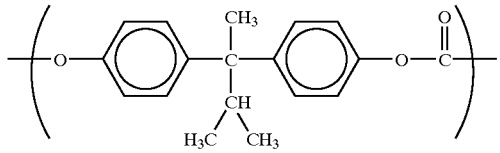
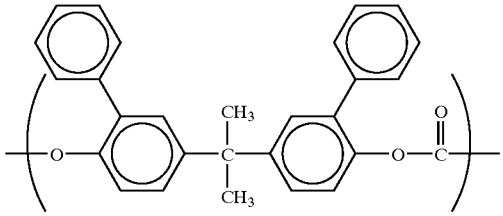
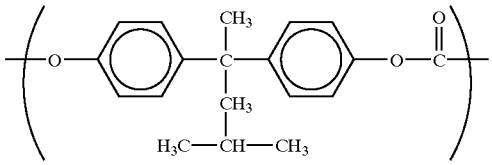
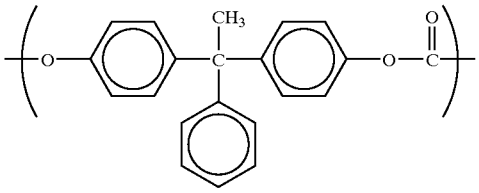
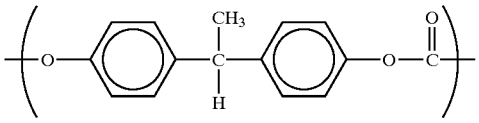
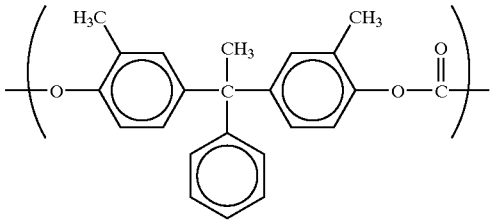
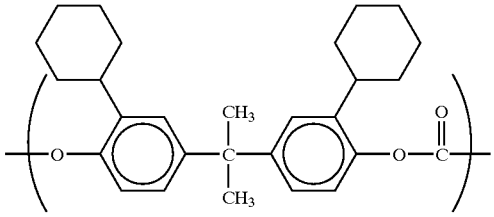

TABLE 1-continued
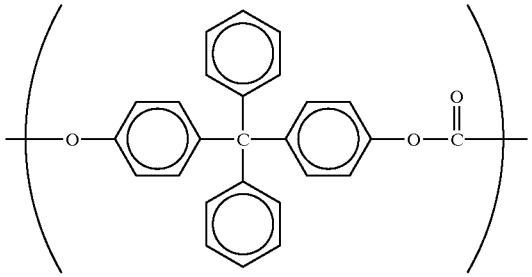
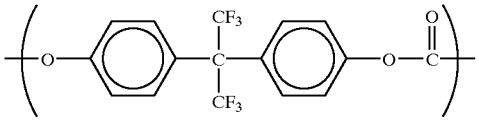
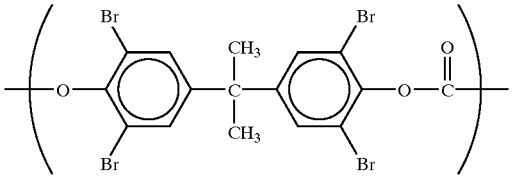
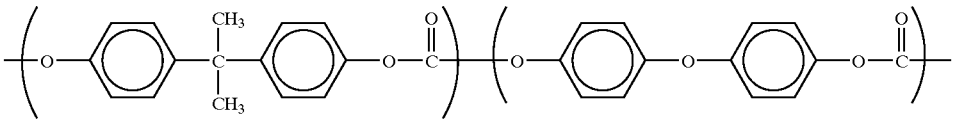
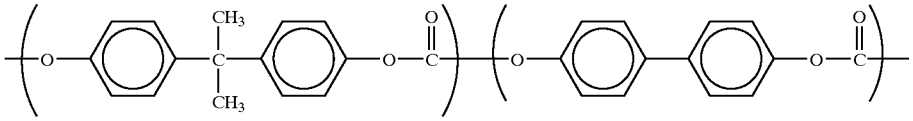
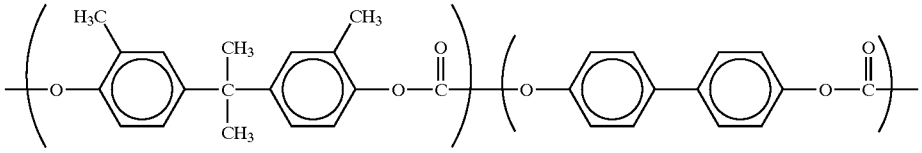
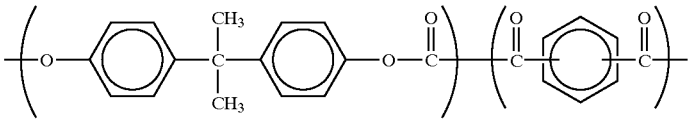
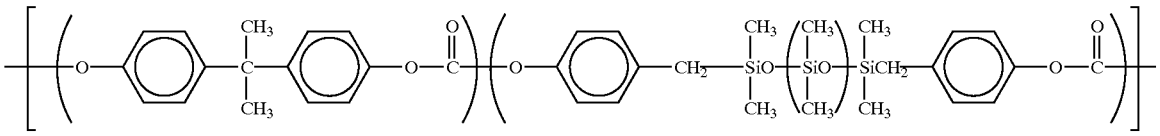
Specific examples of the compounds having formula (2) include the compounds as shown in Table 2.

TABLE 2

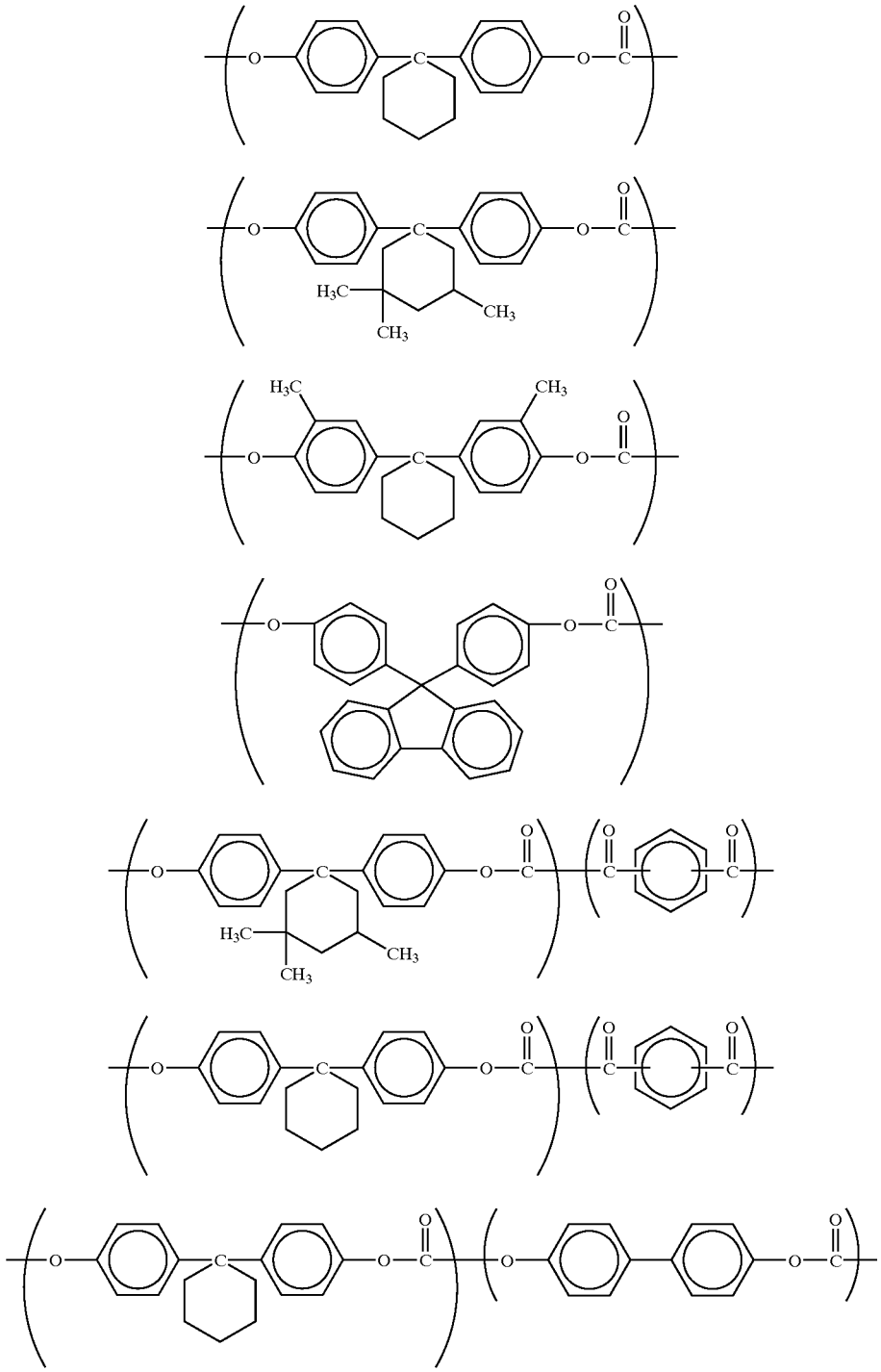

As mentioned above, the protective layer may include a filler such as organic fillers and inorganic fillers.

Specific examples of the organic fillers include powders of fluorine-containing resins such as polytetrafluoroethylene, silicone resin powders and amorphous carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin, and potassium titanate. Among these fillers, inorganic fillers are preferably used in view of hardness. In particular, silica, titanium oxide and alumina are preferably used.

The average primary particle diameter of the filler included in the protective layer is preferably from 0.01 to 0.5 $\mu$m to improve the light-transmittance and abrasion resistance of the protective layer. When the average primary particle diameter of the filler used is too small, the abrasion resistance of the protective layer and the dispersibility of the filler in a coating liquid deteriorate. To the contrary, when the average primary particle diameter of the filler used is too large, the amount of precipitation increases in a coating liquid and a problem such that a film of the toner used is formed on the protective layer tends to occur.

The more the concentration of the filler included in the protective layer, the better the abrasion resistance of the protective layer. However, when the concentration is too high, adverse affects are produced such that residual potential increases and the transmittance of the protective layer against the light used for writing images deteriorates. Therefore the concentration is preferably not greater than 50% by weight, and more preferably not greater than 30% by weight, based on total weight of the protective layer.

The lower limit of the filler concentration should be determined depending on the abrasion resistance of the filler used (i.e., taking into consideration of relationship between the concentration of the filler used and the abrasion). The abrasion resistance of a protective layer largely depends on the filler content in the surface portion of the protective layer. The filler content is preferably not less than 5% by weight and more preferably not less than 10% by weight.

In order to prevent occurrence of blurred images, fillers having a relatively high specific resistance not less than $10^{10}$ Ω·cm are preferably used in the protective layer. In addition, fillers having a pH not less than 5 and/or a dielectric constant not less than 5 are preferably used. These fillers can be used alone or in combination. For example, a combination of a filler having a pH not less than 5 and a filler having a pH not greater than 5; or a combination of a filler having a dielectric constant not less than 5 and a filler having a dielectric constant not greater than 5 can be used.

Among these fillers, α-form alumina, which has a hexagonal close-packed structure, is preferably used to improve abrasion resistance of the resultant protective layer and to prevent the blurred image problem. This is because the alumina has high insulation property, heat stability and good abrasion resistance.

These fillers are preferably treated with at least one surface treating agent to improve the dispersibility thereof. Deterioration of dispersibility of a filler included in the protective layer causes not only increase of residual potential but also decrease of transparency of the protective layer, generation of coating deficiencies, and deterioration of abrasion resistance, and thereby a big problem occurs such that a photoreceptor having good durability and capable of producing good images cannot be provided.

Suitable surface treating agents include known surface treating agents, but surface treating agents which can maintain the insulating properties of the filler to be used in the protective layer are preferable. Specific examples of such surface treating agents include titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and their mixtures. These are preferable because of being able to impart good dispersibility to fillers and to prevent the blurred image problem.

When silane coupling agents are used, the blurred image problem tends to be caused. However, when used in combination with the surface treating agents mentioned above, there is a case in which the problem can be avoided.

The content of a surface treating agent in a coated filler, which depends on the primary particle diameter of the filler, is from 3 to 30% by weight, and more preferably from 5 to 20% by weight. When the content is too low, good dispersibility cannot be obtained. To the contrary, when the content is too high, residual potential seriously increases.

These fillers can be used alone or in combination.

The thickness of the protective layer is preferably from 0.1 to 10 μm.

These fillers can be dispersed by using a proper dispersing machine. The average particle diameter of the filler dispersed in a protective layer coating liquid is preferably from not greater than 1 μm, and more preferably not greater than 0.5 μm.

The protective layer can be formed by a general coating method. Among general coating methods, spray coating methods and ring coating methods can be preferably used.

The protective layer 39 may include a charge transport material to decrease residual potential and to improve the responsibility of the resultant photoreceptor. Specific examples of the charge transport materials include the charge transport materials mentioned above for use in the charge transport layer 37. When a low molecular weight charge transport material is used in the protective layer, the concentration of the low molecular weight charge transport material may be gradient in the thickness direction thereof. In this case, it is preferable that the concentration of the charge transport material at the surface of the protective layer is lower than that at the bottom of the protective layer, to improve the abrasion resistance of the resultant photoreceptor.

The protective layer preferably includes a charge transport polymer material, which has both a binder resin function and a charge transport function, because the resultant protective layer has good abrasion resistance.

Suitable charge transport polymer materials include known charge transport polymer materials. Among these materials, polycarbonate resins having a triarylamine structure in their main chain and/or side chain are preferably used. In particular, charge transport polymer materials having the following formulae of from (6) to (15) are preferably used:

(6)

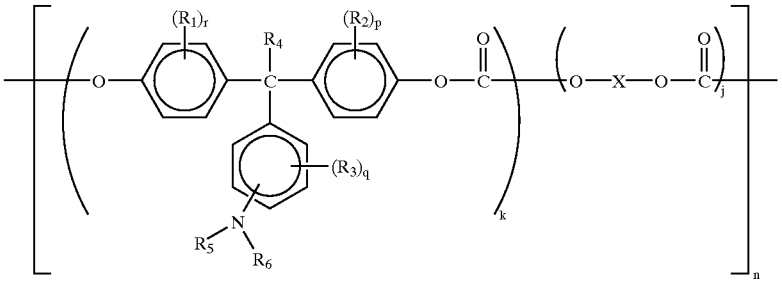

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

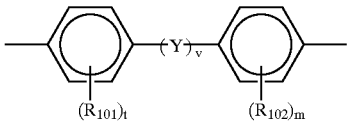

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, a cyclic alkylene group, —O—, —S—, —SO—, —$SO_2$—, —CO—, —CO—O—Z—O—CO— (Z represents a divalent aliphatic group), or a group having the following formula:

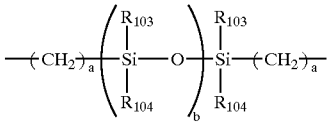

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(7)

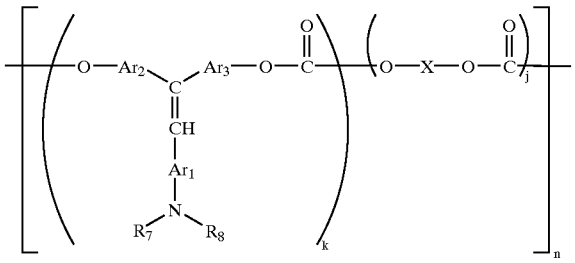

wherein $R_7$ and $R_8$ independently represent a substituted or unsubstituted aryl group; $Ar_1$, $Ar_2$ and $Ar_3$ independently represent an arylene group; and X, k, j and n are defined above in formula (6).

(8)

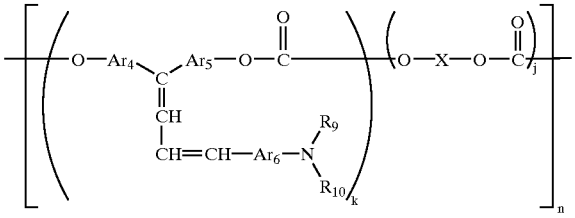

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (6).

(9)

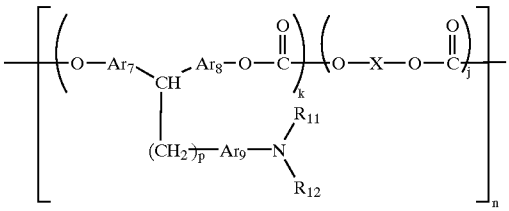

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (6).

(10)

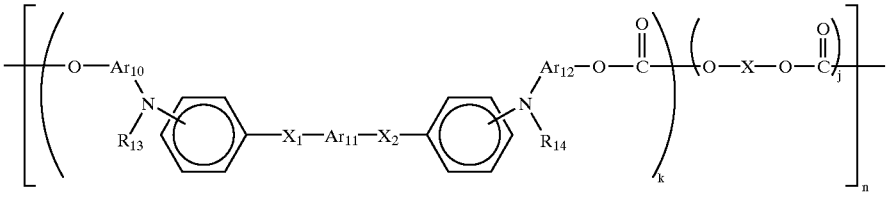

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (6).

(11)

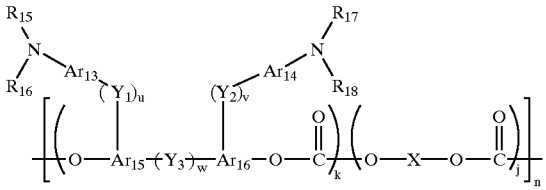

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (6).

(12)

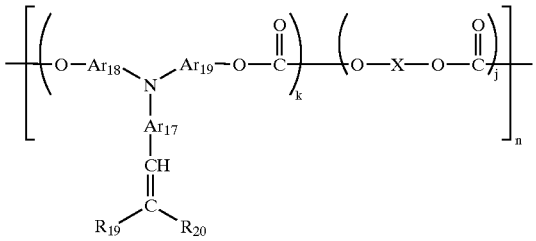

wherein $R_{19}$ and $R_{20}$ independently represent a hydrogen atom, or substituted or unsubstituted aryl group, and $R_{19}$ and $R_{20}$ may form a ring; $Ar_{17}$, $Ar_{18}$ and $Ar_{19}$ independently represent an arylene group; and X, k, j and n are defined above in formula (6).

(13)

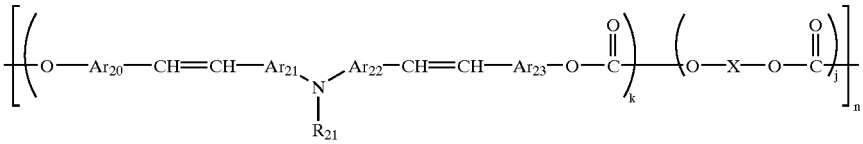

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (6).

(14)

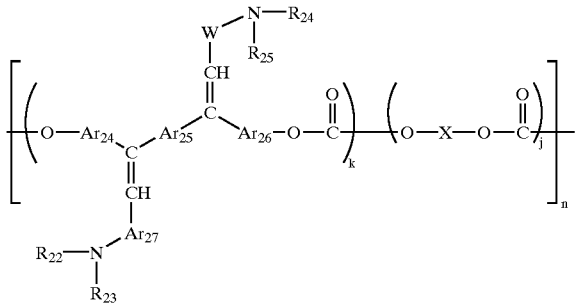

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (6).

(15)

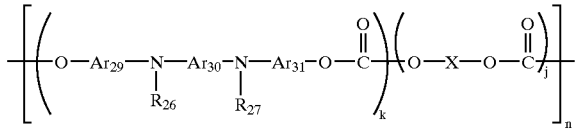

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (6).

In the photoreceptor of the present invention, an intermediate layer may be formed between the photosensitive layer and the protective layer. The intermediate layer includes a resin as a main component. Specific examples of the resin include polyamides, alcohol soluble nylons, water-soluble polyvinyl butyral, polyvinyl butyral, polyvinyl alcohol, and the like. The intermediate layer can be formed by one of the above-mentioned known coating methods. The thickness of the intermediate layer is preferably from 0.05 to 2 $\mu$m.

In the photoreceptor of the present invention, one or more additives such as antioxidants, plasticizers, lubricants, ultraviolet absorbents, low molecular weight charge transport materials and leveling agents can be used in one or more of the layers to improve the stability to withstand environmental conditions, namely to avoid decrease of photosensitivity and increase of residual potential.

Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2, 6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-Containing Compounds dilauryl-3,3'-thiodipropionate, distearyl-3,3'-thiodipropionate, ditetradecyl-3,3'-thiodipropionate, and the like.

(e) Organic Phosphorus-containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-Containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Hereinafter the image forming method and image forming apparatus of the present invention will be explained referring to drawings.

Figure 3:
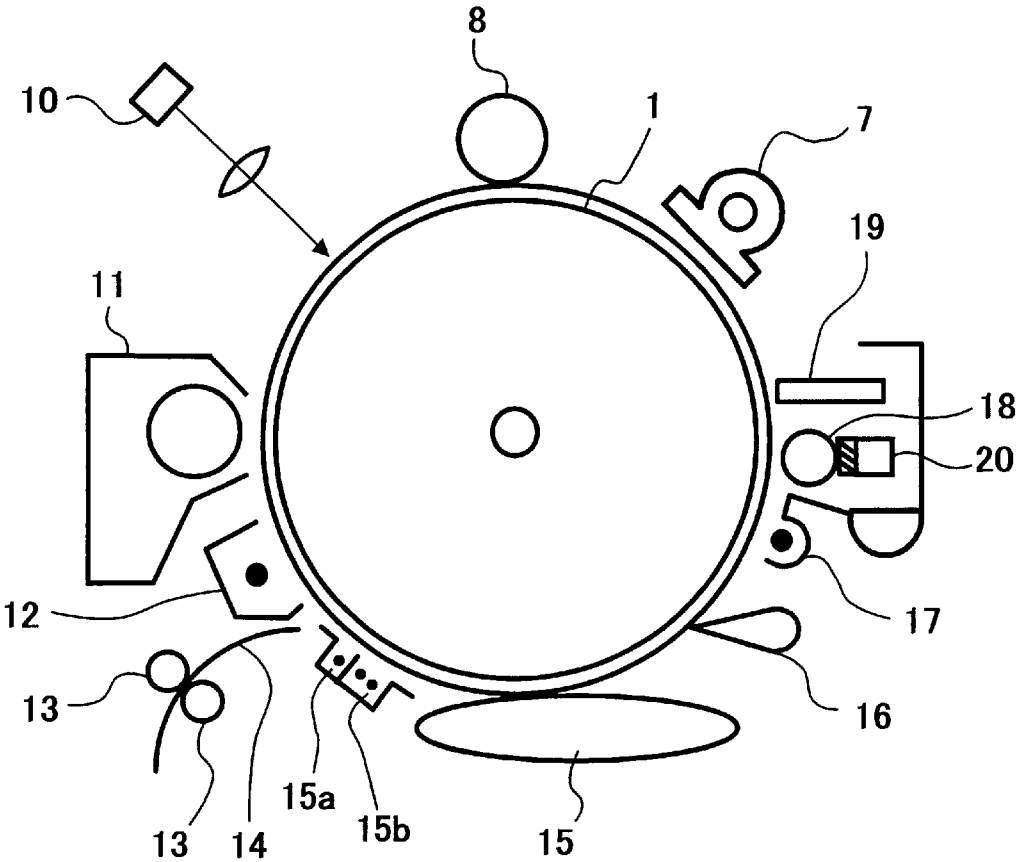
FIG. 3 is a schematic view illustrating an embodiment of the image forming apparatus of the present invention and for explaining the image forming method of the present invention.

FIG. 3 is a schematic view for explaining an embodiment of the image forming method and apparatus of the present invention.

In FIG. 3, numeral 1 denotes a cylindrical photoreceptor. The photoreceptor 1 is the photoreceptor of the present invention in which at least a photosensitive layer and a protective layer are overlaid on an electroconductive substrate, wherein ionic impurities are removed in the extreme from the binder resin included in the protective layer. Although the photoreceptor 1 has a cylindrical shape, but sheet photoreceptors or endless belt photoreceptors can be used.

Around the photoreceptor 1, a discharging lamp 7, a charger 8, an imagewise light irradiator 5, a developing unit 11, a cleaning unit including a cleaning brush 18 and a cleaning blade 19 are arranged while contacting or being set closely to the photoreceptor. The toner image formed on the photoreceptor 1 is transferred onto a receiving paper 14 fed by a pair of registration rollers 13 at a transfer belt 15. The receiving paper 14 having the toner image thereon is separated from the photoreceptor 1 by a separating pick 12.

In the image forming apparatus of the present invention, a pre-transfer charger 12, a transfer charger 15*a*, a separating charger 15*b* and a pre-cleaning charger 17 may be arranged if desired. Known charging devices such as corotrons, scorotrons, solid state chargers and charging rollers can be used. It is preferable that a DC voltage overlapped with an AC voltage is applied to the photoreceptor 1 to reduce uneven charging.

As the transfer device 15, the above-mentioned chargers can be used. Among the chargers, a combination of the transfer charger 15*a* and the separating charger 15*b* is preferably used.

Suitable light sources for use in the imagewise light irradiating device 10 and the discharging lamp 7 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

In the image forming apparatus of the present invention, it is preferable that the discharging lamp 7 is not used. This is because the constituents of the photosensitive layer tend to be deteriorated by the light, resulting in increase of residual potential and decrease of dark-area potential. This depends on the species of the materials used in the photosensitive layer. When the discharging lamp 7 is not used, the effects of the photoreceptor of the present invention can be fully exerted.

The above-mentioned lamps can be used for not only the processes mentioned above and illustrated in FIG. 3, but also other processes using light irradiation, such as a transfer process including light irradiation, a discharging process, a cleaning process including light irradiation and a pre-exposure process.

When the toner image formed on the photoreceptor 1 by the developing unit 11 is transferred onto the receiving paper 14, all of the toner image are not transferred on the receiving paper 14, and residual toner particles remain on the surface of the photoreceptor 1. The residual toner is removed from the photoreceptor 1 by a fur blush 18 and a cleaning blade 19. The residual toner remaining on the photoreceptor 1 can be removed by only a cleaning brush. Suitable cleaning blushes include known cleaning blushes such as fur blushes and mag-fur blushes. A lubricant applicator 20 may be provided to apply a lubricant such as zinc stearate to the photoreceptor via the fur blush 18.

When the photoreceptor 1 which is previously charged positively (or negatively) is exposed to imagewise light, an electrostatic latent image having a positive or negative charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

The image forming apparatus may have a mechanism which applies a lubricant such as zinc stearate to the surface of the photoreceptor 1. By applying zinc stearate on the protective layer, it is possible to prevent filming of the toner used on the surface of the photoreceptor 1 while keeping the good abrasion resistance of the photoreceptor 1. In addition, in the image forming method of the present invention, by repeatedly performing adhesion of toner on the surface of the photoreceptor and collection of the toner at the cleaning section when the above-mentioned image forming processes are not performed, the tailed-image problem can be prevented while the good abrasion resistance is maintained.

The quantity of zinc stearate applied on the photoreceptor 1 is too much, a problem in that insufficiently fixed toner images are produced tends to occur because a large amount of zinc stearate is applied to the toner image. In addition, when the friction coefficient of the surface of the photoreceptor 1 becomes about 0.1 by applying an excess amount of zinc stearate thereto, the image density of the resultant image decreases. To the contrary, when the quantity of zinc stearate is too little, the filming problem of the toner constituents on the surface of the photoreceptor 1 occurs, resulting in occurrence of tailed images and uneven halftone images.

A lubricant such as zinc stearate can be included in the toner used, which is to be applied to the surface of the photoreceptor 1. In this case, the content of the lubricant in the toner is from 0.1 to 0.2% by weight.

In the image forming method, by repeatedly performing adhesion of toner on the photoreceptor at the developing section and collection of the toner at the cleaning section when the above-mentioned image forming processes are not performed, the toner filming problem on the surface of the photoreceptor 1 and a problem in that materials caused by charging adhere and deposit on the surface of the photoreceptor 1 can be prevented. This is because the materials adhered on the surface of the photoreceptor 1 can be removed together with the toner at the cleaning section.

Figure 4:
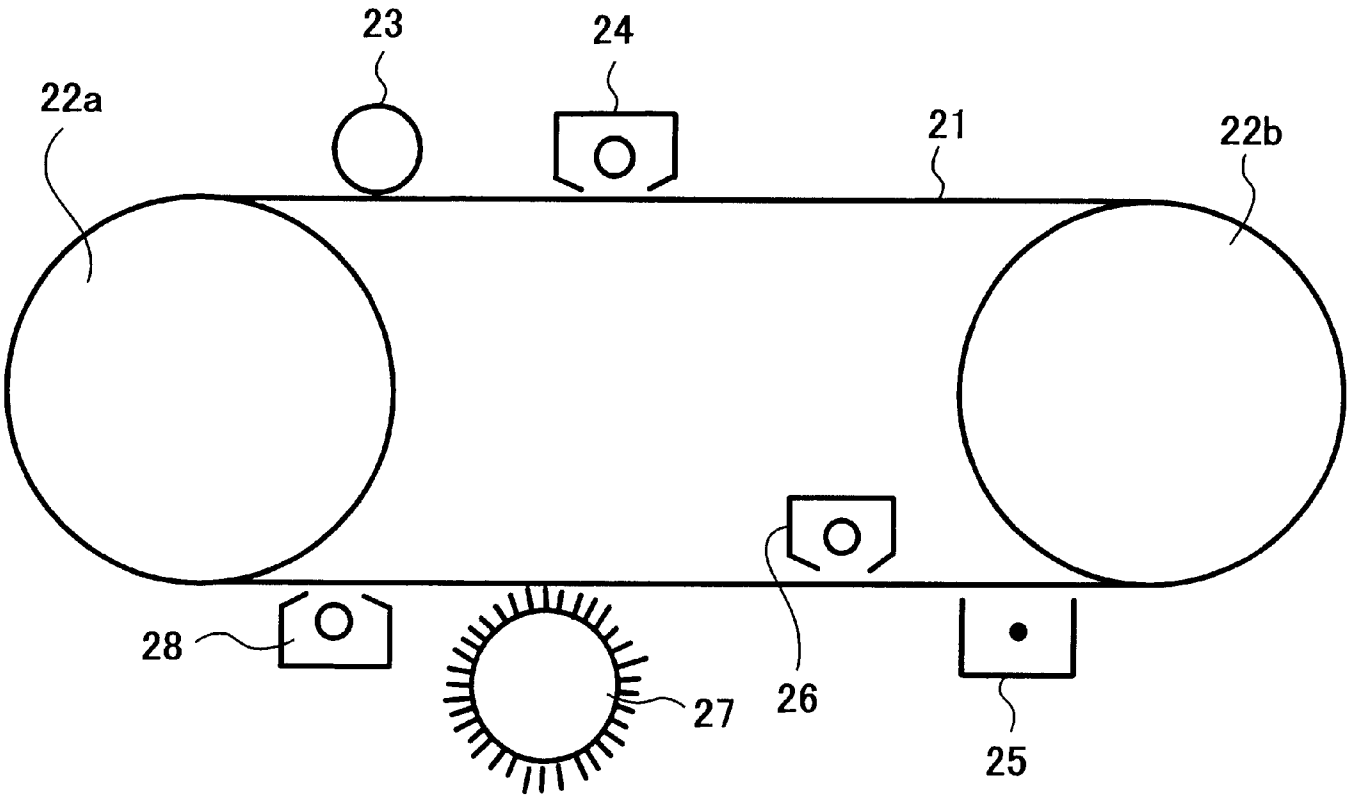
FIG. 4 is a schematic view illustrating another embodiment of the image forming apparatus of the present invention and for explaining the image forming method of the present invention.

FIG. 4 is a schematic view for explaining another embodiment of the image forming method and apparatus of the present invention. In this embodiment, a photoreceptor 21 is the photoreceptor of the present invention and has at least a photosensitive layer and a protective layer overlaid on an electroconductive substrate, wherein ionic impurities are removed in the extreme from the binder resin constituting the protective layer.

The belt-shaped photoreceptor 21 is rotated by rollers 22*a* and 22*b*. The photoreceptor 21 is charged with a charger 23, and then exposed to imagewise light emitted by an imagewise light irradiating device 24 to form an electrostatic latent image in the photoreceptor 21. The latent image is developed with a developing unit (not shown in FIG. 4) to form a toner image on the photoreceptor 21. The toner image is transferred onto a receiving paper (not shown) using a transfer charger 25. After the toner image transferring process, the surface of the photoreceptor 21 is cleaned with a cleaning brush 27 after performing a pre-cleaning light irradiating operation using a pre-cleaning light irradiating device 26. Then the photoreceptor 21 is discharged by being exposed to light emitted by a discharging light source 28. These processes are repeatedly performed.

In the image forming apparatus as shown in FIG. 4, the pre-cleaning light irradiating is performed from the side of the substrate of the photoreceptor 21. In this case, the substrate has to be light-transmissive.

The image forming apparatus of the present invention is not limited to the image forming units as shown in FIGS. 3 and 4. For example, in FIG. 4, the pre-cleaning light irradiating operation can be performed from the photosensitive layer side of the photoreceptor 21. In addition, the light irradiation in the light image irradiating process and the discharging process may be performed from the substrate side of the photoreceptor 21.

As light irradiation processes, the imagewise irradiation process, pre-cleaning irradiation process, and discharging process are performed as mentioned above. In addition, a pre-transfer light irradiation operation, which is performed before the transferring of the toner image, and a preliminary light irradiation operation, which is performed before the imagewise light irradiation, and other light irradiation operations may also be performed.

The above-mentioned image forming unit may be fixedly set in a copier, a facsimile or a printer. However, the image forming unit may be set therein as a process cartridge. The process cartridge means an image forming unit (or device) which includes a photoreceptor, a housing and at least one of a charger, an imagewise light irradiator, an image developer, an image transferer, a cleaner, and a discharger.

Figure 5:
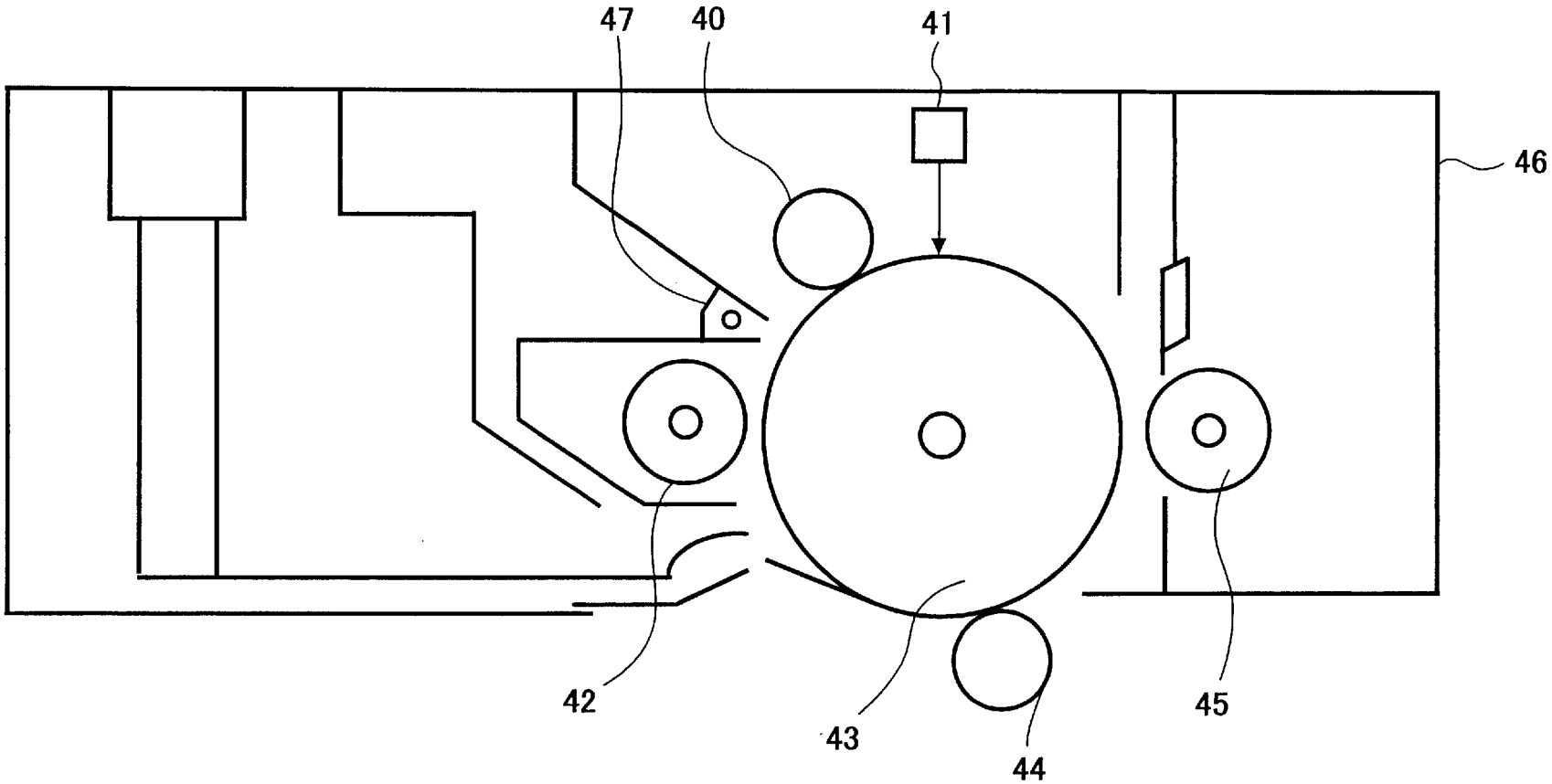
FIG. 5 is a schematic view illustrating an embodiment of the process cartridge of the present invention.

Various process cartridges can be used in the present invention. FIG. 5 is a schematic view illustrating an embodiment of the process cartridge of the present invention. In FIG. 5, the process cartridge includes a photoreceptor 43, and a charger 40, an imagewise light irradiating device 41, a developing roller 45, a transfer roller 44, and a cleaning brush 42, which are arranged around the photoreceptor 43. Numerals 46 and 47 denote a housing and a discharger. The photoreceptor 43 is the photoreceptor of the present invention, which has at least a photosensitive layer and a protective layer overlaid on an electroconductive substrate, wherein ionic impurities are removed in the extreme from the binder resin constituting protective layer.

Figure 7:
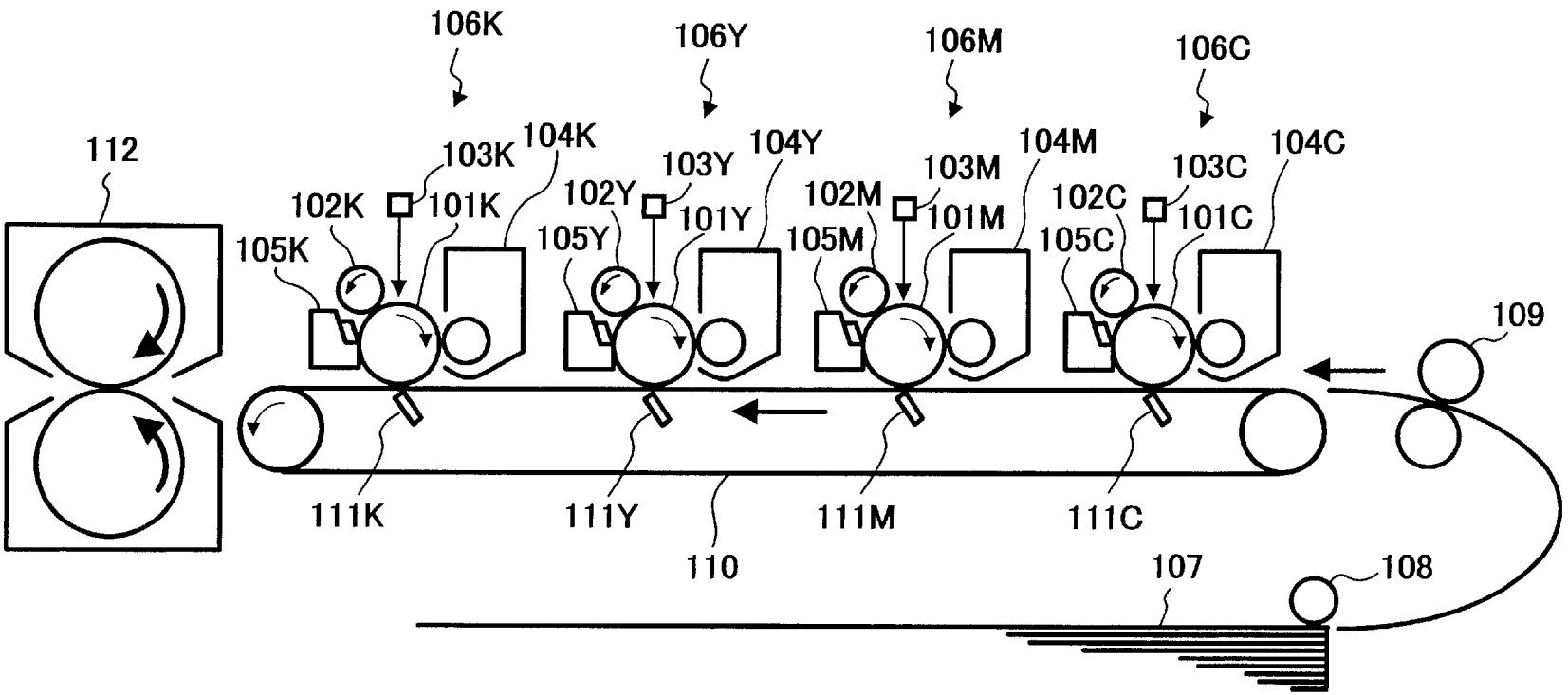
FIG. 7 is a schematic view illustrating yet another embodiment of the image forming apparatus of the present invention.

FIG. 7 is a schematic for explaining yet another embodiment of the image forming method and apparatus of the present invention.

In FIG. 7, the image forming apparatus an endless transfer belt 100, and four color image forming sections, i.e., a black image forming section 106C, a yellow image forming section 106M, a magenta image forming section 106Y and a cyan image forming section 106K. A receiving paper 107 is fed by a feeding roller 108 and timely fed by a pair of registration rollers 109 toward the belt photoreceptor 100.

On the other hand, a cyan color image is formed on a photoreceptor 101C in a method similar to the image forming method mentioned above using a charging roller 102C, an imagewise light irradiator 103C, an image developer 104C and a cleaner 105C. The cyan image formed on the photoreceptor 101C is transferred on the receiving material 107 at the nip between the transfer belt 100 and the photoreceptor 101C using a transfer brush 111C.

Similarly, a magenta color image, a yellow image and a black image formed on respective photoreceptors 101M, 101Y and 101K are also transferred on the receiving material 107 one by one using transfer brushes 111M, 111Y and 111*k*, respectively. Thus full color image is formed on the receiving material 107. The full color image is then fixed by a fixer 112.

Numerals 102K, 102Y and 102M denote charging rollers. Numerals 103K, 103Y and 103M denote imagewise light irradiators. Numerals 104 K, 104Y and 104M denote image developers configured to form black, yellow and magenta toner images, respectively. Numerals 105K, 105Y and 105M denote cleaners.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Refining Example 1

Five parts of a bisphenol A-form polycarbonate resin were dissolved in 95 parts of methylene chloride. The solution was mixed with 100 parts of deionized water having electroconductivity of 0.83 $\mu$S/cm and the mixture was strongly agitated for 30 minutes. The mixture was separated into an organic layer and an aqueous layer using a separating funnel. The electroconductivity of the aqueous layer was 3.44 $\mu$S/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.90 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.31 μS/cm.

Then the thus prepared methylene chloride solution (i.e., the organic layer) was dropped into 2000 ml of methanol to precipitate the polycarbonate resin. The mixture was filtered using an aspirator to obtain the resin. The thus obtained resin was vacuum dried at 100° C. for 2 days.

Thus a refined polycarbonate resin 1 was prepared.

Refining Example 2

Five parts of a bisphenol Z-form polycarbonate resin were dissolved in 95 parts of methylene chloride. The solution was mixed with 100 parts of deionized water having electroconductivity of 0.83 μS/cm and the mixture was strongly agitated for 30 minutes. The mixture was separated into an organic layer and an aqueous layer using a separating funnel. The electroconductivity of the aqueous layer was 2.28 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.61 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.64 μS/cm.

Then the thus prepared methylene chloride solution (i.e., the organic layer) was dropped into 2000 ml of methanol to precipitate the polycarbonate resin. The mixture was filtered using an aspirator to obtain the resin. The thus obtained resin was vacuum dried at 100° C. for 2 days.

Thus a refined polycarbonate resin 2 was prepared.

Refining Example 3

Five parts of a bisphenol C-form polycarbonate resin were dissolved in 95 parts of methylene chloride. The solution was mixed with 100 parts of deionized water having electroconductivity of 0.73 μS/cm and the mixture was strongly agitated for 30 minutes. The mixture was separated into an organic layer and an aqueous layer using a separating funnel. The electroconductivity of the aqueous layer was 3.88 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.90 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.87 μS/cm.

Then the thus prepared methylene chloride solution (i.e., the organic layer) was dropped into 2000 ml of methanol to precipitate the polycarbonate resin. The mixture was filtered using an aspirator to obtain the resin. The thus obtained resin was vacuum dried at 100° C. for 2 days.

Thus a refined polycarbonate resin 3 was prepared.

Refining Example 4

Five parts of a bisphenol C-form polycarbonate resin, which was sampled from a lot different from the lot from which the polycarbonate resin used in Refining Example 3 was sampled, were dissolved in 95 parts of methylene chloride. The solution was mixed with 100 parts of deionized water having electroconductivity of 0.59 μS/cm and the mixture was strongly agitated for 30 minutes. The mixture was separated into an organic layer and an aqueous layer using a separating funnel. The electroconductivity of the aqueous layer was 3.95 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.70 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.53 μS/cm.

Then the thus prepared methylene chloride solution (i.e., the organic layer) was dropped into 2000 ml of methanol to precipitate the polycarbonate resin. The mixture was filtered using an aspirator to obtain the resin. The thus obtained resin was vacuum dried at 100° C. for 2 days.

Thus a refined polycarbonate resin 4 was prepared.

Refining Example 5

Five parts of a bisphenol C-form polycarbonate resin, which was sampled from a lot different from the lots from which the polycarbonate resins used in Refining Examples 3 and 4 were sampled, were dissolved in 95 parts of methylene chloride. The solution was mixed with 100 parts of deionized water having electroconductivity of 0.93 μS/cm and the mixture was strongly agitated for 30 minutes. The mixture was separated into an organic layer and an aqueous layer using a separating funnel. The electroconductivity of the aqueous layer was 5.26 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.60 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.49 μS/cm.

Then the thus prepared methylene chloride solution (i.e., the organic layer) was dropped into 2000 ml of methanol to precipitate the polycarbonate resin. The mixture was filtered using an aspirator to obtain the resin. The thus obtained resin was vacuum dried at 100° C. for 2 days.

Thus a refined polycarbonate resin 5 was prepared.

Refining Example 6

Five parts of a charge transport polymer including a repeating unit having the following formula were dissolved in 95 parts of methylene chloride.

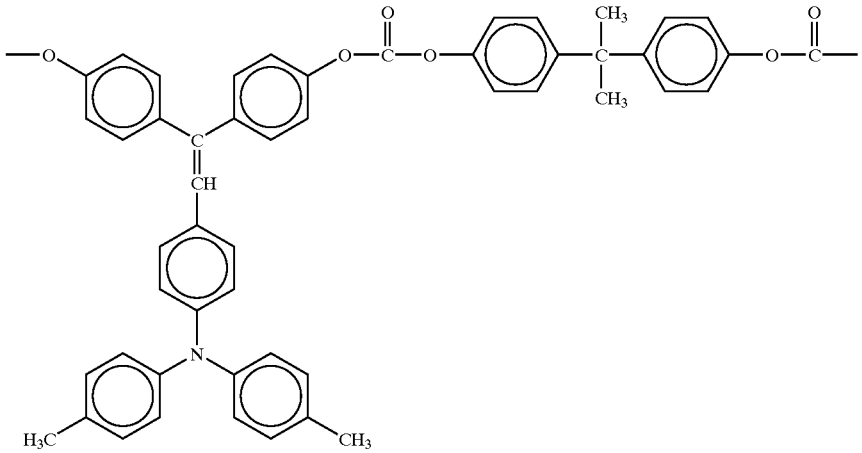

wherein the polystyrene conversion weight average molecular weight (Mw) is 145,000 and the ratio Mw/Mn of the weight average molecular weigh (Mw) to the number average molecular weight (Mn) is 3.0.

The solution was mixed with 100 parts of deionized water having electroconductivity of 0.68 μS/cm and the mixture was strongly agitated for 30 minutes. The mixture separated into an organic layer and an aqueous layer was using a separating funnel. The electroconductivity of the aqueous layer was 4.67 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.59 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.32 μS/cm.

Then the thus prepared methylene chloride solution (i.e., the organic layer) was dropped into 2000 ml of methanol to precipitate the polymer. The mixture was filtered using an aspirator to obtain the polymer. The thus obtained polymer was vacuum dried at 100° C. for 2 days.

Thus a refined charge transport polymer 6 was prepared.

Refining Example 7

Five parts of a charge transport polymer including a repeating unit having the following formula were dissolved in 95 parts of methylene chloride.

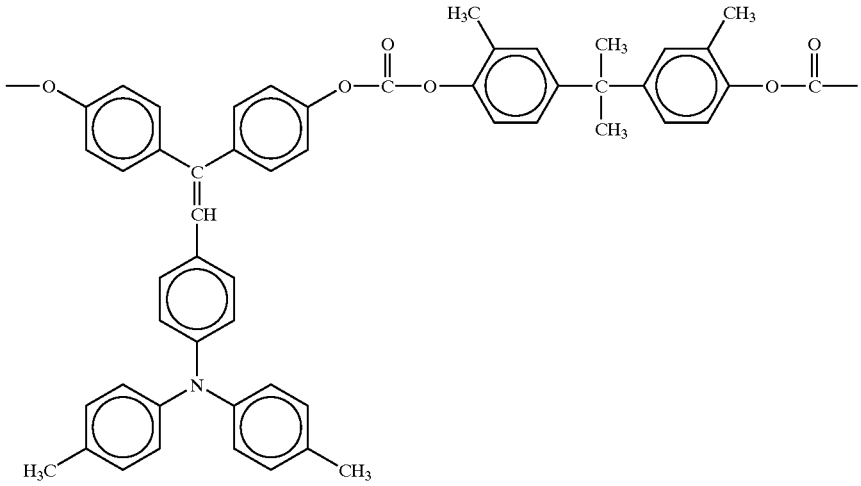

wherein the polystyrene conversion weight average molecular weight (Mw) is 153,000 and the ratio Mw/Mn of the weight average molecular weight (Mw) to the number average molecular weight (Mn) is 2.9.

The solution was mixed with 100 parts of deionized water having electroconductivity of 0.68 μS/cm and the mixture was strongly agitated for 30 minutes. The mixture was separated into an organic layer and an aqueous layer using a separating funnel. The electroconductivity of the aqueous layer was 5.23 μS/cm.

Then the organic layer was mixed with a 5% sodium hydroxide aqueous solution and the mixture was strongly agitated for 30 minutes. After separating the organic layer from the mixture using a separating funnel, the organic layer was mixed with a 2% hydrochloric acid and the mixture was strongly agitated for 1 hour. The organic layer was separated from the mixture using a separating funnel. The organic layer was then mixed with 100 parts of deionized water having electroconductivity of 0.62 μS/cm and the mixture was strongly agitated for 30 minutes. The mixture was separated into an organic layer and an aqueous layer using a separating funnel. The electroconductivity of the aqueous layer was measured. These processes were repeated until the electroconductivity of the aqueous layer became a desired value (i.e., not greater than 2 μS/cm). In this case, the electroconductivity of the aqueous layer was 1.48 μS/cm.

Then the thus prepared methylene chloride solution (i.e., the organic layer) was dropped into 2000 ml of methanol to precipitate the polymer. The mixture was filtered using an aspirator to obtain the polymer. The thus obtained polymer was vacuum dried at 100° C. for 2 days.

Thus a refined charge transport polymer 7 was prepared.

Example 1

Formation of Undercoat Layer

The following components were mixed to prepare an undercoat layer coating liquid.

| | |
|---|---|
| Titanium dioxide (CR-EL from Ishihara Sangyo Kaisha, Ltd.) | 400 |
| Melamine resin | 65 |
| Alkyd resin | 120 |
| 2-butanone | 400 |

The undercoat layer coating liquid was coated on an aluminum cylinder by a dip coating method, and then dried. Thus, an undercoat layer having a thickness of 3.5 μm was formed.

Formation of Charge Generation Layer

The following components were mixed to prepare a charge generation layer coating liquid.

| | |
|---|---|
| Bisazo pigment having the following formula | 10 |

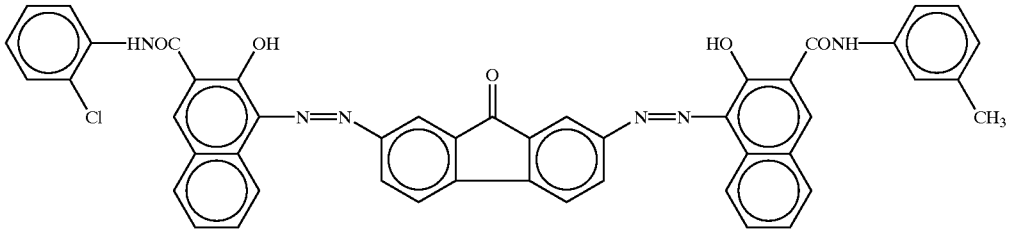

-continued

| | |
|---|---|
| Polyvinyl butyral | 2 |
| 2-butanone | 200 |
| Cyclohexanone | 400 |

The charge generation layer coating liquid was coated on the undercoat layer by a dip coating method, and then dried. Thus a charge generation layer having a thickness of 0.2 μm was formed.

Formation of Charge Transport Layer

The following components were mixed to prepare a charge transport layer coating liquid.

| | |
|---|---|
| Bisphenol A-form polycarbonate | 10 |
| Low molecular weight charge transport material having the following formula (a) | |

(a)

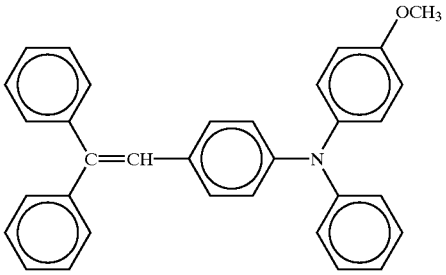

| | |
|---|---|
| Tetrahydrofuran | 200 |

The charge transport layer coating liquid was coated on the charge generation layer by a dip coating method, and then dried. Thus, a charge transport layer having a thickness of 20 μm was formed.

Formation of Protective Layer

The following components were mixed to prepare a protective layer coating liquid.

| | |
|---|---|
| Refined polycarbonate resin 1 | 10 |
| Low molecular weight charge transport material having following (a) | 7 |
| Particulate alumina (specific resistance of $2.5 \times 10^{12}$ Ω · cm, and average primary particle diameter of 0.3 μm) | 4 |
| Tetrahydrofuran | 400 |
| Cyclohexanone | 200 |

The protective layer coating liquid was coated on the charge transport layer by a spray coating method, and then dried. Thus, a protective layer having a thickness of 5 μm was formed.

Thus, a photoreceptor of Example 1 was prepared.

Example 2

The procedure for preparation of the photoreceptor in Example 1 was repeated except that the formulation of the charge transport layer coating liquid was changed to the following.

| Charge transport layer coating liquid | |
|---|---|
| Refined polycarbonate resin 1 | 10 |
| Low molecular weight charge transport material having formula (a) | 8 |
| Tetrahydrofuran | 200 |

Thus, a photoreceptor of Example 2 was prepared.

Example 3

The procedure for preparation of the photoreceptor in Example 1 was repeated except that the refined polycarbonate resin 1 in the protective layer coating liquid was replaced with the refined polycarbonate resin 2.

Thus, a photoreceptor of Example 3 was prepared.

Example 4

The procedure for preparation of the photoreceptor in Example 2 was repeated except that the refined polycarbonate resin 1 in the protective layer coating liquid was replaced with the refined polycarbonate resin 2.

Thus, a photoreceptor of Example 4 was prepared.

Example 5

The procedure for preparation of the photoreceptor in Example 1 was repeated except that the refined polycarbonate resin 1 in the protective layer coating liquid was replaced with the refined polycarbonate resin 3.

Thus, a photoreceptor of Example 5 was prepared.

Example 6

The procedure for preparation of the photoreceptor in Example 1 was repeated except that the formulation of the protective layer was changed to the following.

| Protective layer coating liquid | |
|---|---|
| Refined charge transport polymer material 6 | 17 |
| Particulate alumina (specific resistance of $2.5 \times 10^{12}$ Ω · cm, and average primary particle diameter of 0.3 μm) | 4 |
| Tetrahydrofuran | 400 |
| Cyclohexanone | 200 |

Thus, a photoreceptor of Example 6 was prepared.

Example 7

The procedure for preparation of the photoreceptor in Example 2 was repeated except that the formulation of the protective layer was changed to the following and the thickness of the charge transport layer and the protective layer was changed to 23 μm and 2 μm, respectively.

| Protective layer coating liquid | |
|---|---|
| Refined polycarbonate resin 1 | 17 |
| Particulate alumina (specific resistance of $2.5 \times 10^{12}$ Ω · cm, and average primary particle diameter of 0.3 μm) | 4 |
| Tetrahydrofuran | 400 |
| Cyclohexanone | 200 |

Thus, a photoreceptor of Example 7 was prepared.

Example 8

The procedure for preparation of the photoreceptor in Example 4 was repeated except that the formulation of the protective layer was changed to the following.

| Protective layer coating liquid | |
|---|---|
| Refined polycarbonate resin 2 | 10 |
| Refined charge transport polymer material 6 | 10 |
| Tetrahydrofuran | 400 |
| Cyclohexanone | 200 |

Thus, a photoreceptor of Example 8 was prepared.

Comparative Example 1

The procedure for preparation of the photoreceptor in Example 1 was repeated except that the refined polycarbonate resin 1 was replaced with the unrefined polycarbonate resin used in Refining Example 1.

Thus, a photoreceptor of Comparative Example 1 was prepared.

Comparative Example 2

The procedure for preparation of the photoreceptor in Example 1 was repeated except that the refined polycarbonate resin 1 was replaced with the unrefined polycarbonate resin used in Refining Example 2.

Thus, a photoreceptor of Comparative Example 2 was prepared.

Comparative Example 3

The procedure for preparation of the photoreceptor in Example 1 was repeated except that the refined polycarbonate resin 1 was replaced with the unrefined polycarbonate resin used in Refining Example 3.

Thus, a photoreceptor of Comparative Example 3 was prepared.

Comparative Example 4

The procedure for preparation of the photoreceptor in Example 1 was repeated except that the refined polycarbonate resin 1 was replaced with the unrefined charge transport polymer material used in Refining Example 6.

Thus, a photoreceptor of Comparative Example 4 was prepared.

Comparative Example 5

The procedure for preparation of the photoreceptor in Example 1 was repeated except that the protective layer was not formed and the thickness of the charge transport layer was changed to 25 μm.

Thus, a photoreceptor of Comparative Example 5 was prepared.

Comparative Example 6

The procedure for preparation of the photoreceptor in Example 1 was repeated except that the protective layer was not formed, the formulation of the charge transport layer coating liquid was changed to the following, and the thickness of the charge transport layer was changed to 25 μm.

| charge transport layer coating liquid | |
|---|---|
| Refined charge transport polymer material 6 | 10 |
| Tetrahydrofuran | 200 |

Thus, a photoreceptor of Comparative Example 6 was prepared.

Evaluation 1

Each of the photoreceptors of Examples 1 to 8 and Comparative Examples 1 to 6 was evaluated by being set in a copier having a construction similar to that as shown in FIG. 3. A running test in which 30,000 images were continuously produced at room temperature and normal humidity was performed while the pre-cleaning light irradiation was not performed and a scorotron type charger was used as the charger. Light images were written on the photoreceptor using a laser diode emitting light having a wavelength of 655 nm as a light source and a polygon mirror.

At the beginning and end of the running test, the qualities of the images produced by each photoreceptor were visually evaluated. In addition, the lighted-area potential (VL) of each photoreceptor was measured at the developing section. In addition, the abrasion quantity of each photoreceptor was also measured.

The results are shown in Table 3.

TABLE 3

| | Image qualities (Beginning) | Image qualities (End) | VL (Beginning) (−V) | VL (End) (−V) | Abrasion quantity (μm) |
|---|---|---|---|---|---|
| Ex. 1 | Good | Good | 80 | 90 | 1.2 |
| Ex. 2 | Good | Good | 75 | 85 | 1.2 |
| Ex. 3 | Good | Good | 80 | 95 | 1.0 |
| Ex. 4 | Good | Good | 75 | 85 | 1.0 |
| Ex. 5 | Good | Good | 85 | 100 | 1.0 |
| Ex. 6 | Good | Good | 85 | 100 | 0.7 |
| Ex. 7 | Good | Good | 80 | 100 | 0.6 |
| Ex. 8 | Good | Good | 80 | 95 | 1.4 |
| Comp. Ex. 1 | Good | Low image density | 90 | 140 | 1.2 |
| Comp. Ex. 2 | Good | Low image density | 90 | 150 | 1.0 |
| Comp. Ex. 3 | Good | Low image density | 95 | 175 | 1.0 |
| Comp. Ex. 4 | Good | Low image density | 100 | 180 | 0.7 |
| Comp. Ex. 5 | Good | Black streak image | 80 | 120 | 4.0 |
| Comp. Ex. 6 | Good | Slight black streak image | 90 | 105 | 2.4 |

As can be understood from Table 3, the photoreceptors of the present invention having a protective layer including the refined binder resin have relatively low abrasion quantity (i.e., relatively good durability) compared to those of the comparative photoreceptors having no protective layer (i.e., Comparative Examples 5 and 6). In addition, the photoreceptors of the present invention have good charge properties such that the increase of residual potential is less than that of the comparative photoreceptors, and thereby good images can be produced.

By using a refined resin in the photosensitive layer (i.e., the charge transport layer), the increase of residual potential can be further curbed.

When an unrefined binder resin having ionic impurities in an amount not less than 2 $\mu$S/cm is used in the protective layer, the residual potential seriously increases, and thereby undesired images are produced although the photoreceptors have good abrasion resistance.

When a filler is included in the protective layer, the abrasion resistance can be dramatically improved, and the effect can be further enhanced when the filler is used in combination with a charge transport polymer.

Example 9

The procedure for evaluation of the photoreceptor of Example 1 was repeated except that the scorotron charger in the copier was changed to a charging roller which applied a DC bias voltage of −920 V to the photoreceptor while contacting the photoreceptor.

As a result, the first and 30,000$^{th}$ images were good. However, the 30,000$^{th}$ image had slight background development which is caused by toner film formation on the charging roller. The odor of ozone in continuous copying was much less than in the case in which the scorotron charger was used.

Example 10

The procedure for evaluation of the photoreceptor of Example 9 was repeated except that an insulating tape having a thickness of 50 $\mu$m and a width of 5 mm was adhered on both ends of the charging roller to form a gap of 50 $\mu$m between the photoreceptor and the charger.

As a result, the toner film formation on the charging roller was not observed, and the first and 30,000$^{th}$ images were good. However, the half tone images produced after the running test were slightly uneven, which is caused by uneven charging.

Example 11

The procedure for evaluation of the photoreceptor of Example 10 was repeated except that the charging conditions were changed as follows.

DC bias applied: −900V

AC bias applied: 2.0 kV (peak to peak voltage), 2 kHz (frequency)

As a result, the initial and 30,00$^{th}$ images had good image qualities. The soil of the charging roller which was observed in Example 9 and the uneven half-tone images observed in Example 10 were not observed.

Example 12

Formation of Undercoat Layer

The following components were mixed to prepare an undercoat layer coating liquid.

| | |
|---|---|
| Titanium dioxide powder | 100 |
| Alcohol-soluble nylon | 100 |
| Methanol | 500 |
| Butanol | 300 |

The undercoat layer coating liquid was coated on a nickel belt by a dip coating method, and then dried to form an undercoat layer having a thickness of 3 $\mu$m.

Formation of Charge Generation Layer

The following components were mixed to prepare a charge generation layer coating liquid.

Bisazo pigment having the following formula 2

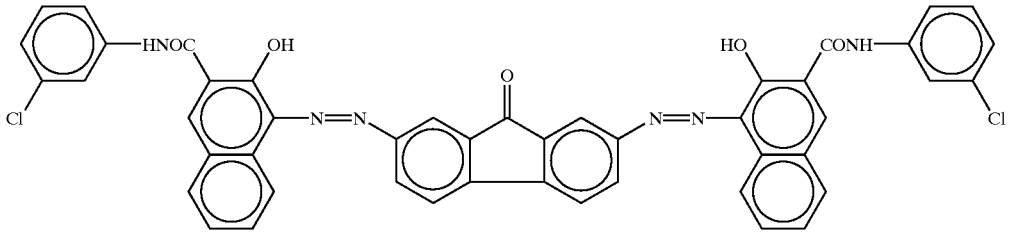

Trisazo pigment having the following formula 8

-continued

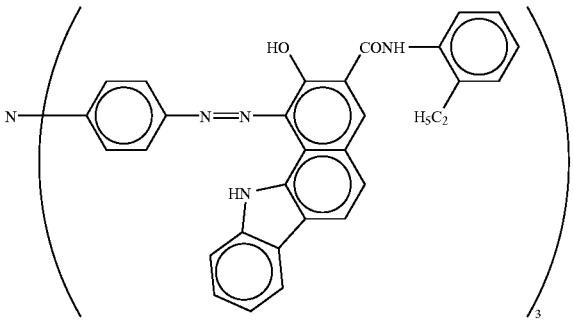

| | |
|---|---|
| Polyvinyl butyral | 2 |
| 2-butanone | 200 |
| Cyclohexanone | 400 |

The charge generation layer coating liquid was coated on the undercoat layer by a dip coating method, and then dried to form a charge generation layer having a thickness of 0.3 μm.

Formation of Charge Transport Layer

The following components were mixed to prepare a charge transport layer coating liquid.

| | |
|---|---|
| Bisphenol Z-from polycarbonate | 10 |
| Charge transport material having the following formula (b) | 7 |

(b)

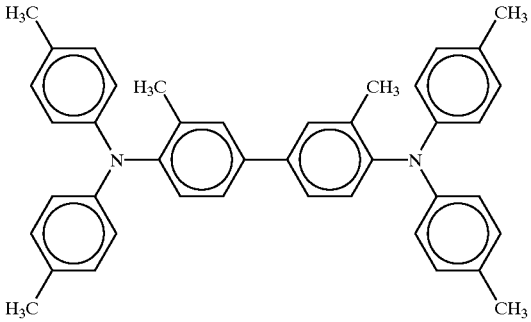

| | |
|---|---|
| Tetrahydrofuran | 200 |

The charge transport layer coating liquid was coated on the charge generation layer by a dip coating method, and then dried to form a charge transport layer having a thickness of 22 μm.

Formation of Protective Layer

The following components were mixed to prepare a protective layer coating liquid.

| | |
|---|---|
| Refined polycarbonate resin 2 | 10 |
| Charge transport material having formula (b) | 6 |
| Particulate titanium oxide (specific resistance of $1.5 \times 10^{10}$ Ω · cm) | 4 |
| Toluene | 600 |

The protective layer coating liquid was coated on the charge transport layer by a ring coating method, and then dried to prepare a protective layer having a thickness of 3 μm.

Thus, a photoreceptor of example 12 was prepared.

Example 13

The procedure for preparation of the photoreceptor in Example 12 was repeated except that the polycarbonate resin in the protective layer coating liquid was replaced with the refined polycarbonate resin 4.

Thus a photoreceptor of Example 13 was prepared.

Example 14

The procedure for preparation of the photoreceptor in Example 12 was repeated except that the polycarbonate resin in the protective layer coating liquid was replaced with the refined polycarbonate resin 5.

Thus a photoreceptor of Example 14 was prepared.

Example 15

The procedure for preparation of the photoreceptor in Example 12 was repeated except that the protective layer coating liquid was changed to the following.

| Protective layer coating liquid | |
|---|---|
| Refined charge transport polymer material 7 | 16 |
| Compound having the following formula (c) | 1 |

(c)

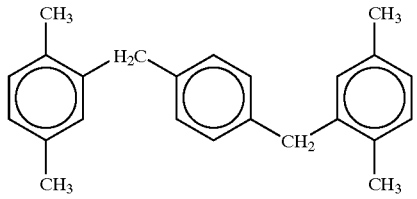

| | |
|---|---|
| Particulate titanium oxide (specific resistance of $1.5 \times 10^{10}$ Ω · cm) | 4 |
| Toluene | 600 |

Thus, a photoreceptor of Example 15 was prepared.

Example 16

The procedure for preparation of the photoreceptor in Example 12 was repeated except that the protective layer coating liquid was changed to the following.

| Protective layer coating liquid | |
|---|---|
| Refined polycarbonate resin 2 | 10 |
| Charge transport material having formula (b) | 6 |
| Particulate silica (specific resistance of $5 \times 10^{13}$ Ω · cm) | 5 |
| Toluene | 600 |

Thus, a photoreceptor of Example 16 was prepared.

Example 17

The procedure for preparation of the photoreceptor in Example 12 was repeated except that the protective layer coating liquid was changed to the following.

| Protective layer coating liquid | |
|---|---|
| Refined polycarbonate resin 2 | 10 |
| Charge transport material having formula (b) | 6 |
| Electroconductive titanium oxide (specific resistance of $7.1 \times 10^{7}$ Ω · cm) | 5 |
| Toluene | 600 |

Thus, a photoreceptor of Example 17 was prepared.

Comparative Example 7

The procedure for preparation of the photoreceptor of Example 12 was repeated except that the polycarbonate resin in the protective layer coating liquid was replaced with the unrefined polycarbonate resin used in Refining Example 2.

Thus, a photoreceptor of Comparative Example 7 was prepared.

Comparative Example 8

The procedure for preparation of the photoreceptor of Example 13 was repeated except that the polycarbonate resin in the protective layer coating liquid was replaced with the unrefined polycarbonate resin used in Refining Example 4.

Thus, a photoreceptor of Comparative Example 8 was prepared.

Comparative Example 9

The procedure for preparation of the photoreceptor of Example 14 was repeated except that the polycarbonate resin in the protective layer coating liquid was replaced with the unrefined polycarbonate resin used in Refining Example 5.

Thus, a photoreceptor of Comparative Example 9 was prepared.

Comparative Example 10

The procedure for preparation of the photoreceptor of Example 15 was repeated except that the charge transport polymer material in the protective layer coating liquid was replaced with the unrefined charge transport polymer material used in Refining Example 7.

Thus, a photoreceptor of Comparative Example 10 was prepared.

Comparative Example 11

The procedure for preparation of the photoreceptor of Example 12 was repeated except that the protective layer was not formed and the thickness of the charge transport layer was changed to 25 μm.

Thus, a photoreceptor of Comparative Example 11 was prepared.

Each of the thus prepared photoreceptors of Examples 12 to 17 and Comparative Examples 7 to 11 was set in an image forming apparatus having construction as shown in FIG. 4, and a running test in which 30,000 images were continuously produced at room temperature and normal humidity was performed using a laser diode emitting light having a wavelength of 780 nm as the light source of the image irradiator and without performing the pre-cleaning light irradiation operation.

At the beginning and end of the running test, the qualities of the images produced by each photoreceptor were visually evaluated. In addition, the dark-area potential (VD) of each photoreceptor was measured at the developing section. In addition, the abrasion quantity of each photoreceptor was measured.

The results are shown in Table 4.

TABLE 4

| | Image qualities (Beginning) | Image qualities (End) | VD (Beginning) (−V) | VD (End) (−V) | Abrasion quantity (μm) |
|---|---|---|---|---|---|
| Ex. 12 | Good | Good | 850 | 830 | 1.0 |
| Ex. 13 | Good | Good | 860 | 840 | 0.9 |
| Ex. 14 | Good | Good | 860 | 840 | 0.9 |
| Ex. 15 | Good | Good | 850 | 830 | 0.6 |
| Ex. 16 | Good | Good | 850 | 820 | 1.2 |
| Ex. 17 | Good | Resolution slightly deteriorated | 840 | 770 | 1.0 |
| Comp. Ex. 7 | Good | Background development | 850 | 740 | 1.0 |
| Comp. Ex. 3 | Good | Background development | 860 | 730 | 0.9 |
| Comp. Ex. 9 | Good | Background development | 860 | 740 | 0.9 |
| Comp. Ex. 10 | Good | Background development | 850 | 700 | 0.7 |
| Comp. Ex. 11 | Good | Serious background development Black streaks | 850 | 690 | 3.5 |

As can be understood from Table 4, the photoreceptors of the present invention having a protective layer including the refined binder resin have relatively low abrasion quantity (i.e., relatively good durability) compared to those of the comparative photoreceptors having no protective layer. In addition, the photoreceptors of the present invention have good charge properties such that the decrease of the dark-area potential is less than that of the comparative photoreceptors, and thereby good images can be produced.

When an unrefined binder resin having ionic impurities in an amount not less than 2 μS/cm is used in the protective layer, the dark-area potential seriously decreases, and thereby undesired images are produced.

When a filler is included in the protective layer, the abrasion resistance can be dramatically improved, and the effect can be further enhanced when the filler is used in combination with a charge transport polymer.

In addition, the photoreceptors which had been subjected to the 30,000-image running test was then subjected to another running test in which 500 images were continuously produced at 30° C. 90% RH. The photoreceptor of Comparative Example 11 was not subjected to the 500-image running test because its image qualities were seriously bad.

As a result, the photoreceptors of Examples 12 to 16 did not produce undesired images, but the photoreceptors of Example 17 but Comparative Examples 7 to 10 produced blurred images, resulting in deterioration of resolution of the images. The blurred image produced by the photoreceptor of Example 17 was better than those produced by the photoreceptors of Comparative Examples 7 to 10.

Examples 18 and 19 and Comparative Examples 12 and 13

The photoreceptors of Examples 12 and 13 and Comparative Examples 7 and 8 were subjected to a gas exposure test in which each photoreceptor was settled in an atmosphere including NOx gasses in an amount of 50 ppm for 4 days (i.e., the photoreceptors of Examples 18 and 19 and Comparative Examples 12 and 13). Before and after the gas exposure test, images were produced using each of the photoreceptors and the image forming apparatus as shown in FIG. 4.

As a result, the resolution of the images produced by the photoreceptors of Examples 18 and 19 hardly deteriorated but the resolution of the images produced by the photoreceptor of Comparative Examples 12 and 13 seriously deteriorated because the images were blurred.

Examples 20 to 22

The filler used in the protective layer coating liquid was treated with a titanate coupling agent or alumina such that the weight of the treating agent was 20%.

Protective layer coating liquids were prepared in the same way as performed in Example 12 using the filler coated with the titanate coupling agent (Example 21) or the filler coated with alumina (Example 22).

The average particle diameter of the filler, which was measured by CAPA500 from Horiba, Ltd., and the dispersibility of the filler with respect to the protective layer coating liquids of Example 12 (i.e., Example 20) and Examples 21 and 22 were evaluated. With respect to the dispersibility, the filler in each coating liquid contained in a test tube was visually observed whether the filler precipitated.

The results are shown in Table 5.

TABLE 5

| | Protective layer coating liquid used | Average particle diameter (μm) | Dispersibility |
|---|---|---|---|
| Ex. 20 | Example 12 | 0.86 | Precipitated filler was first observed when the liquid was preserved for 2 days |
| Ex. 21 | Example 21 | 0.65 | Precipitated filler was first observed when the liquid was preserved for 5 days |
| Ex. 22 | Example 22 | 0.68 | Precipitated filler was first observed when the liquid was preserved for 5 days |

TABLE 5-continued

Examples 23 to 25

The procedure for preparation of the photoreceptor of Example 12 was repeated using the protective layer coating liquids of Examples 20 to 22.

In addition, each of the protective layer coating liquids was coated on a respective polyester film to form a protective layer thereon. The transmittance of the protective layers formed on the polyester film was measured using light having a wavelength of 780 nm.

Further, the ten-point mean roughness of the protective layers was also measured.

The results are shown in Table 6.

TABLE 6

| | Protective layer coating liquid used | Appearance of the formed protective layer | Rz (ten-point mean roughness) (μm) | Transmittance (%) |
|---|---|---|---|---|
| Ex. 23 | Example 12 (i.e., Example 20) | Slightly crowded | 0.90 | 88 |
| Ex. 24 | Example 21 | Glossy | 0.60 | 95 |
| Ex. 25 | Example 22 | Glossy | 0.63 | 93 |

Examples 26 and 27

The procedure for evaluation of the photoreceptor of Example 12 was repeated using the photoreceptors of Examples 24 and 25.

As a result, the resolution of the images produced by the photoreceptors of Examples 24 and 25 were better than that of the photoreceptor of Example 12.

Example 28

Formation of Undercoat Layer

The following components were mixed to prepare an undercoat layer coating liquid.

| | |
|---|---|
| Titanium dioxide | 400 |
| Melamine resin | 65 |
| Alkyd resin | 120 |
| 2-butanone | 400 |

The undercoat layer coating liquid was coated on an aluminum cylinder, and then dried to form an undercoat layer having a thickness of 3.5 μm.

Formation of Charge Generation Layer

The following components were mixed to prepare a charge generation layer coating liquid.

Figure 6:
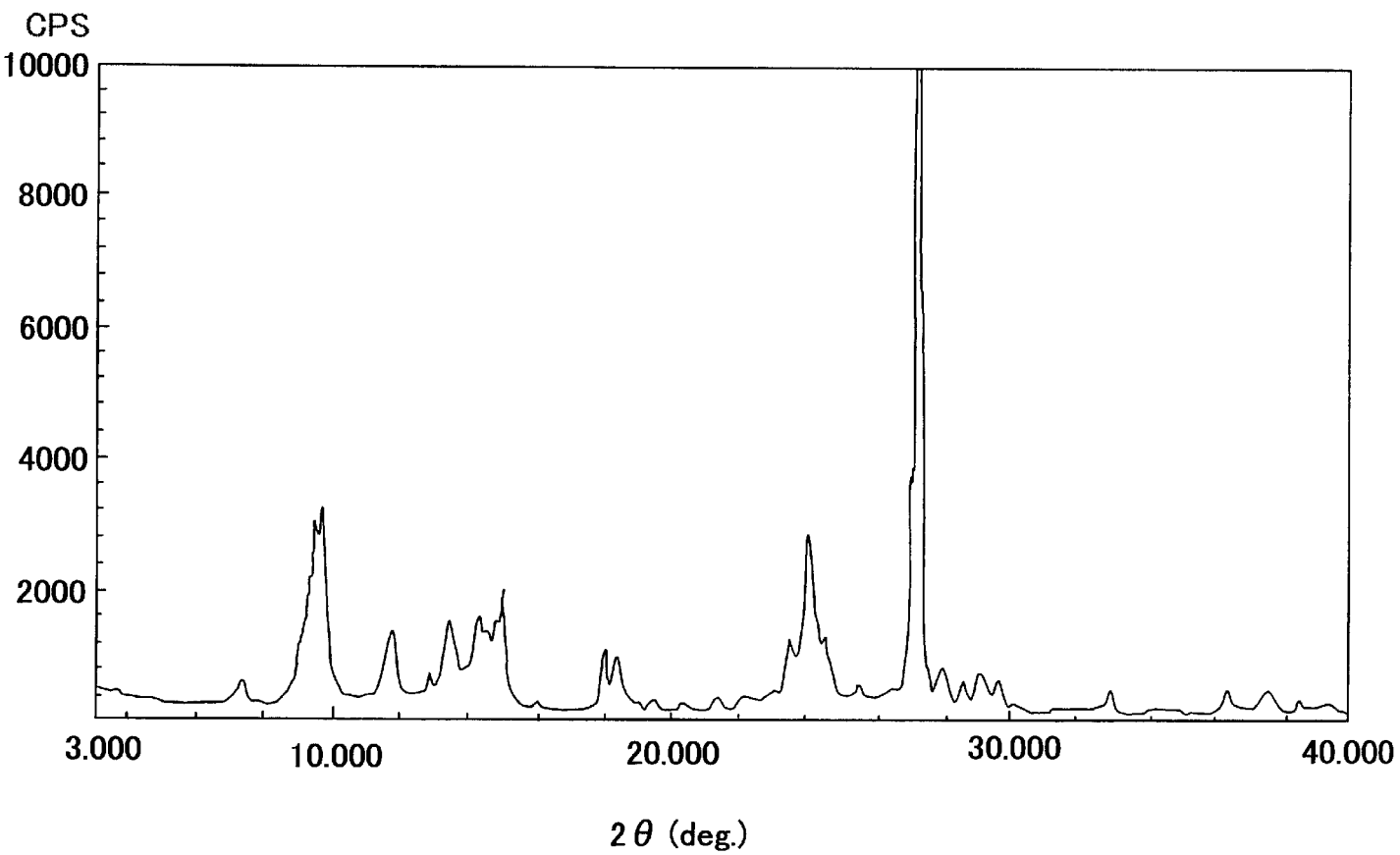
FIG. 6 is an X-ray spectrum of the titanyl phthalocyanine used in Examples of the present application.

| | |
|---|---|
| Titanylphthalocyanine having the X-ray diffraction spectrum as shown in FIG. 6 | 8 |
| Polyvinyl butyral | 5 |
| 2-butanone | 400 |

The charge generation layer coating liquid was coated on the undercoat layer, and then dried to form a charge generation layer having a thickness of 0.2 μm.

Formation of Charge Transport Layer

The following components were mixed to prepare a charge transport layer coating liquid.

| | |
|---|---|
| Polyarylate | 10 |
| Charge transport material having the following formula (d) | 7 |

(d)

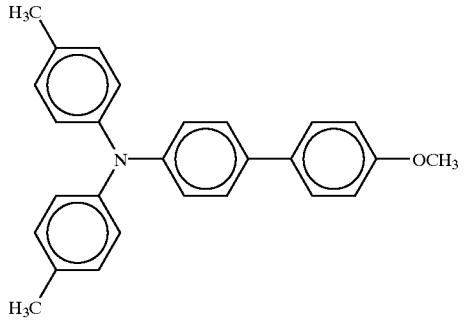

| | |
|---|---|
| Methylene chloride | 80 |

The charge transport layer coating liquid was coated on the charge generation layer, and then dried to form a charge transport layer having a thickness of 21 μm.

Formation of Protective Layer

The following components were mixed to prepare a protective layer coating liquid.

| | |
|---|---|
| Refined polycarbonate resin 2 | 9 |
| Charge transport material having formula (d) | 7 |
| Particulate alumina (specific resistance of $2.5 \times 10^{12}$ Ω · cm, and average primary particle diameter of 0.3 μm) | 3 |
| tetrahydrofuran | 400 |
| Cyclohexanone | 200 |

The protective layer coating liquid was coated on the charge transport layer, and then dried to prepare a protective layer having a thickness of 4 μm.

Thus, a photoreceptor of Example 28 was prepared.

Example 29

The procedure for preparation of the photoreceptor of Example 28 was repeated except that the protective layer coating liquid was changed to the following.

| Protective layer coating liquid | |
|---|---|
| Refined charge transport polymer material 7 | 16 |
| Compound having the following formula (c) | 1 |

-continued

| | |
|---|---|
| Protective layer coating liquid | |
| Particulate alumina (specific resistance of $2.5 \times 10^{12}$ Ω · cm, and average primary particle diameter of 0.3 μm) | 3 |
| Tetrahydrofuran | 400 |
| Cyclohexanone | 200 |

Thus, a photoreceptor of Example 29 was prepared.

Comparative Example 14

The procedure for preparation of the photoreceptor of Example 28 was repeated except that the polycarbonate resin used in the protective layer coating liquid was replaced with the unrefined polycarbonate resin used in Refining Example 2.

Thus a photoreceptor of Comparative Example 14 was prepared.

Comparative Example 15

The procedure for preparation of the photoreceptor of Example 29 was repeated except that the charge transport polymer material used in the protective layer coating liquid was replaced with the unrefined charge transport polymer material used in Refining Example 7.

Thus a photoreceptor of Comparative Example 15 was prepared.

Each of the thus prepared photoreceptors of Examples 28 and 29 and Comparative Examples 14 and 15 was set in a process cartridge having construction as shown in FIG. 5, and a running test in which 20,000 images were continuously produced using a laser diode having a wavelength of 780 nm as a light source for imagewise light irradiation and a polygon mirror. The image qualities of the first and $20{,}000^{th}$ images were evaluated. In addition, the quantity of abrasion of each photoreceptor was measured.

The results are shown in Table 7.

TABLE 7

| | Image qualities (First image) | Image qualities ($20{,}000^{th}$ image) | Abrasion (μm) |
|---|---|---|---|
| Ex. 23 | good | Good | 1.0 |
| Ex. 29 | good | Good | 0.7 |
| Comp. Ex. 14 | good | Resolution deteriorated | 1.0 |
| Comp. Ex. 15 | good | Low image density Background development | 0.7 |

Example 30

The procedure for preparation of the photoreceptor of Example 1 was repeated except that the toner used for development was changed to a toner in which a zinc stearate powder was added to the toner in an amount of 0.15%. Thus, a running test of 50,000 images was performed. In addition, a running test of 50,000 images using the toner in which the zinc stearate powder was not added (i.e., under the conditions of Example 1) was also performed for comparison purpose.

As a result, the image qualities of the first and $50{,}000^{th}$ images were excellent under the conditions of Example 30.

Specifically, the 50,000$^{th}$ image did not have uneven half tone images. In addition, there was no abnormality on the surface of the photoreceptor.

In contrast, the 50,000$^{th}$ image produced under the condition of Example 1 had slightly uneven half tone images. In addition, slight toner-filming was observed on the surface of the photoreceptor.

Example 31

The procedure for the 50,000-image running test using the photoreceptor of Example 1 was repeated except that non-image forming processes including a light irradiation process for irradiating entire the surface of the photoreceptor with imagewise light (i.e., irradiating the surface of the photoreceptor so that an all black image is formed); a developing process with the toner; and a toner collecting process of collecting the toner on the surface of the photoreceptor at the cleaning section, were performed after every 1,000 images.

As a result, the 50,000$^{th}$ image had excellent image qualities, and did not have uneven half tone images.

In addition, after the running test, ten images were produced at 30° C. and 90% RH. The images had image qualities as good as those of the 50,000$^{th}$ image produced at room temperature and normal humidity.

In contrast, the resolution of the ten images produced at 30° C. and 90% RH after the 50,000-image running test without performing the non-image forming processes (i.e., under the conditions of Example 1) slightly deteriorated.

Example 32

The procedure for the 30,000-image running test of the photoreceptor of Example 11 was performed except that the discharging lamp was removed from the image forming apparatus.

The image qualities and the lighted-area potential (VL) of the photoreceptor are shown in Table 8.

TABLE 8

| | Image qualities (first image) | Image qualities (30,000$^{th}$ image) | VL (beginning of running test) (−V) | VL (end of running test) (−V) |
|---|---|---|---|---|
| Ex. 9 | good | good | 80 | 95 |
| Ex. 32 | good | good | 80 | 80 |

Examples 33 and 34 and Comparative Examples 16 and 17

The photoreceptors of Examples 28 and 29 and Comparative Examples 14 and 15 were set in a tandem-type image forming apparatus having a structure as shown in FIG. 7 to perform a 20,000-image running test.

As a result, the photoreceptors of Examples 28 and 29 produced good images after the running test, however, the photoreceptors of Comparative Examples 14 and 15 produced images having a problem in that the color tone of half tone images was different from that of the original image.

Effects of the Present Invention

As mentioned above, the problems, which are caused by forming a protective layer on a surface of a photoreceptor in order to improve the durability of the photoreceptor, can be solved by removing in the extreme ionic impurities from the binder resin to be used in the protective layer. Thereby a photoreceptor having good durability and capable of stably producing high quality images can be provided.

Specifically, a photoreceptor having good mechanical durability and electrostatic durability (i.e., increase of residual potential, decrease of dark-area potential and deterioration of image qualities caused by occurrence of blurred images are prevented) is provided. In other words, a photoreceptor, which can stably produce high quality images even when used for a long period of time. In addition, the photoreceptor is stable even when environmental conditions such as temperature and humidity change and even when used in an atmosphere including reactive gasses.

Further, by using such a photoreceptor, a miniaturized image forming apparatus including a photoreceptor having a small diameter or a high speed image forming apparatus, in both of which the photoreceptor can be used for a long period of time, can be provided. Furthermore, an electrophotographic image forming method, an electrophotographic image forming apparatus and a process cartridge for electrophotographic image forming apparatus, by which high quality images can be stably produced even when used for a long period of time, are provided.

This document claims priority and contains subject matter related to Japanese Patent Applications Nos. 2000-305428 and 2001-051714, filed on Oct. 4, 2000, and Feb. 27, 2001, respectively, incorporated herein by reference.

Having now fully described the invention, it will be apparent to one of ordinary skill in the art that many changes and modifications can be made thereto without departing from the spirit and scope of the invention as set forth therein.

It is noted that the organic solvent that the binder resin is dissolved in during the refining process is incompatible or hardly compatible with deionized water. In this case "incompatible with water" is defined as an organic solvent having a solubility to water of not greater than 3 grams per 100 grams of water at 20° C.

In addition, it is noted that the cleaning process of the present invention is different from the ordinary cleaning process performed after the image transfer process, and is performed when copying operations are not performed. In order to adhere a toner onto the surface of a photoreceptor, for example, the following methods can be used:

1) the toner on the developing section (roller) is adhered to the photoreceptor without applying a bias voltage while the photoreceptor and developing roller are rotated (In this case, when the photoreceptor is slightly fatigued, a considerable amount of toner particles are adhered to the photoreceptor.);
2) the toner on the developing roller is adhered to the photoreceptor while controlled bias voltages are applied to the photoreceptor and developing roller, and the photoreceptor and developing roller are rotated, to adhere a desired amount of toner particles on the photoreceptor; and
3) after the entire surface of the photoreceptor is charged and then exposed to light, the toner on the developing roller is adhered on the surface of the photoreceptor while the photoreceptor and developing roller are rotated (In this case, a solid toner image is formed on the entire surface of the photoreceptor (i.e., a large amount of the toner adheres thereon)).

What is claimed as new and desired to be secured by Letters Patent of the United States is:

1. An electrophotographic photoreceptor comprising:

an electroconductive substrate;

a photosensitive layer overlying the electroconductive substrate; and a protective layer overlying the photosensitive layer and comprising a binder resin, wherein the binder resin comprises materials such that when a solution of the binder resin dissolved in an organic solvent incompatible with water is mixed and agitated with deionized water having an electroconductivity not greater than 1 $\mu$S/cm and substantially the same weight as that of the solvent, the deionized water has an electroconductivity not greater than 2 $\mu$S/cm.

2. The photoreceptor according to claim 1, wherein the binder resin is a binder resin that has been subjected to a refinement treatment to remove ionic impurities therefrom.

3. The photoreceptor according to claim 2, wherein the binder resin is a binder resin subjected to a refinement treatment that uses at least an acid and an alkali.

4. The photoreceptor according to claim 1, wherein the binder resin comprises a polycarbonate resin.

5. The photoreceptor according to claim 4, wherein the polycarbonate resin comprises a repeating unit having a formula selected from the group consisting of the following formulae (A) and (B):

(A)

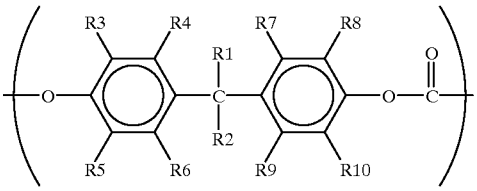

wherein R1 and R2 each represent a hydrogen atom, a substituted or unsubstituted aliphatic group, a substituted or unsubstituted carbon ring, or a substituted or unsubstituted aromatic group; and R3 to R10 each represent a hydrogen atom, a halogen atom, a substituted or unsubstituted aliphatic group, or a substituted or unsubstituted carbon ring, and (B)

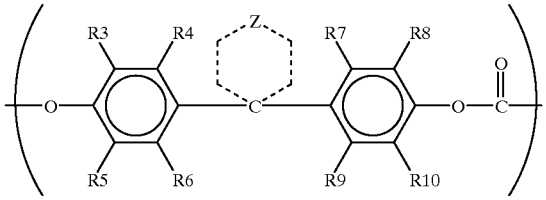

wherein R3 to R10 each represent a hydrogen atom, a halogen atom, a substituted or unsubstituted aliphatic group, or a substituted or unsubstituted carbon ring; and Z represents a substituted or unsubstituted carbon ring, or an atom group needed for forming an unsubstituted heterocyclic group.

6. The photoreceptor according to claim 5, wherein the repeating unit of the polycarbonate resin is one of the following formulae (1), (2) and (3):

(1)

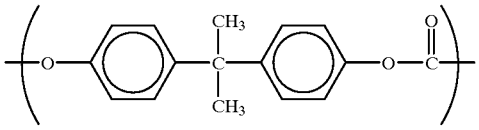

(2)

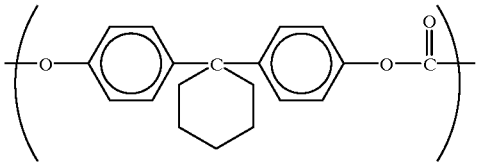

(3)

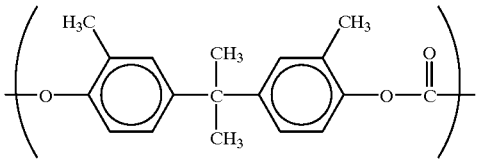

7. The photoreceptor according to claim 1, wherein the photosensitive layer comprises a binder resin, and wherein the binder resin of the photosensitive layer comprises materials such that when a solution of the binder resin of the photosensitive layer dissolved in an organic solvent incompatible with water is mixed and agitated with deionized water having an electroconductivity not greater than 1 $\mu$S/cm and substantially the same weight as that of the solvent, the deionized water has an electroconductivity not greater than 2 $\mu$S/cm.

8. The photoreceptor according to claim 1, wherein the photosensitive layer comprises a charge generation layer and a charge transport layer comprising a binder resin, and wherein the binder resin of the charge transport layer comprises materials such that when a solution of the binder resin of the charge transport dissolved in an organic solvent incompatible with water is mixed and agitated with deionized water having an electroconductivity not greater than 1 $\mu$S/cm and substantially the same weight as that of the solvent, the deionized water has an electroconductivity not greater than 2 $\mu$S/cm.

9. The photoreceptor according to claim 1, wherein the protective layer comprises a filler.

10. The photoreceptor according to claim 9, wherein the filler comprises an inorganic pigment having a specific resistance not less than $10^{10}$ CM.

11. The photoreceptor according to claim 10, wherein the inorganic pigment is a metal oxide.

12. The photoreceptor according to claim 11, wherein the metal oxide is selected from the group consisting of silica, alumina and titanium oxide.

13. The photoreceptor according to claim 10, wherein the inorganic pigment has a pH not less than 5.

14. The photoreceptor according to claim 10, wherein the inorganic pigment has a dielectric constant not less than 5.

15. The photoreceptor according to claim 10, wherein the inorganic pigment has a surface that is treated with a surface treating agent.

16. The photoreceptor according to claim 15, wherein the surface is a surface treated with a surface treating agent selected from the group consisting of titanate coupling agents, aluminum coupling agents, higher fatty acids, $Al_2O_3$, $TiO_2$ and $ZrO_2$, and mixtures thereof, and combinations of a silane coupling agent with at least one of titanate coupling agents, aluminum coupling agents, higher fatty acids, $Al_2O_3$, $TiO_2$ and $ZrO_2$.

17. The photoreceptor according to claim 15, wherein a ratio (Ws/Wf) of a weight (Ws) of the surface treating agent to a weight (Wf) of the filler is from 0.03 to 0.30.

18. The photoreceptor according to claim 9, wherein the filler has an average primary particle diameter of from 0.01 to 0.5 μm.

19. The photoreceptor according to claim 1, wherein the protective layer further comprises a charge transport material.

20. The photoreceptor according to claim 19, wherein the charge transport material is a charge transport polymer.

21. The photoreceptor according to claim 20, wherein the charge transport polymer comprises a triarylamine structure in at least one of a main chain and a side chain of the charge transport polymer.

22. The photoreceptor according to claim 1, further comprising an undercoat layer between the electroconductive substrate and the photosensitive layer.

23. The photoreceptor according to claim 1, further comprising an intermediate layer between the photosensitive layer and the protective layer.

24. An image forming method comprising:

providing a photoreceptor having an electroconductive substrate, a photosensitive layer overlying the substrate, and a protective layer overlying the photosensitive layer and including a binder resin that includes materials such that when a solution of the binder resin dissolved in an organic solvent incompatible with water is mixed and agitated with deionized water having an electroconductivity not greater than 1 μS/cm and substantially the same weight as that of the solvent, the deionized water has an electroconductivity not greater than 2 μS/cm;

charging the photoreceptor;

irradiating the photoreceptor with light to form an electrostatic latent image on a surface of the photoreceptor;

developing the electrostatic latent image with a toner to form a toner image on the photoreceptor; and transferring the toner image onto a receiving material.

25. The image forming method according to claim 24, wherein the irradiating step includes digitally irradiating light using at least one of a laser diode and a light emitting diode.

26. The image forming method according to claim 24, further comprising:

applying zinc stearate on a surface of the photoreceptor.

27. The image forming method according to claim 24, wherein the developing step comprises developing the electrostatic latent image with a toner that comprises zinc stearate.

28. The image forming method according to claim 24, further comprising:

cleaning the surface of the photoreceptor, wherein the cleaning step comprises:

adhering the toner onto the surface of the photoreceptor; and collecting the toner, and wherein the cleaning step is performed at a time when the charging, irradiating, developing and transferring steps are not performed.

29. An image forming apparatus comprising:

a photoreceptor;

a charger configured to charge the photoreceptor;

an image irradiator configured to irradiate the photoreceptor with light to form an electrostatic latent image on the photoreceptor;

an image developer configured to develop the electrostatic latent image with a toner to form a toner image on the photoreceptor; and an image transferer configured to transfer the toner image onto a receiving material, wherein the photoreceptor comprises:

an electroconductive substrate;

a photosensitive layer overlying the electroconductive substrate; and a protective layer overlying the photosensitive layer and comprising a binder resin, wherein the binder resin comprises materials such that when a solution of the binder resin dissolved in an organic solvent incompatible with water is mixed and agitated with deionized water having an electroconductivity not greater than 1 μS/cm and substantially the same weight as that of the solvent, the deionized water has an electroconductivity not greater than 2 μS/cm.

30. The image forming apparatus according claim 29, further comprising one of a laser diode and a light emitting diode configured to emit light used by the image irradiator to digitally irradiate the photoreceptor.

31. The image forming apparatus according claim 29, wherein the charger is one of a contact charger and a proximity charger configured to charge the photoreceptor while close to but not touching the surface of the photoreceptor.

32. The image forming apparatus according claim 29, wherein the charger is configured to charge the photoreceptor by applying a DC voltage overlapped with an AC voltage to the surface of the photoreceptor.

33. The image forming apparatus according claim 28, further comprising:

a lubricant applicator configured to apply zinc stearate to the surface of the photoreceptor.

34. The image forming apparatus according claim 28, wherein the forming apparatus does not include a discharger configured to discharge a residual potential of the photoreceptor using light.

35. A process cartridge comprising:

a photoreceptor;

a housing configured to contain the photoreceptor therein; and at least one of the following devices:

a charger configured to charge the photoreceptor;

an image irradiator configured to irradiate the photoreceptor with light to form an electrostatic latent image thereon;

an image developer configured to develop the electrostatic latent image with a toner to form a toner image thereon;

an image transferer configured to transfer the toner image onto a receiving material;

a cleaner configured to clean the surface of the photoreceptor; and a discharger configured to decrease a residual potential of the photoreceptor, wherein the photoreceptor comprises:

an electroconductive substrate;

a photosensitive layer overlying the electroconductive substrate; and a protective layer overlying the photosensitive layer and comprising a binder resin, wherein the binder resin comprises materials such that when a solution of the binder resin is dissolved in an organic solvent incompatible with water is mixed and agitated with deionized water having an electroconductivity not greater than 1 $\mu$S/cm and substantially the same weight as that of the solvent, the deionized water has an electroconductivity not greater than 2 $\mu$S/cm.

* * * * *